US006021377A

United States Patent [19]

Dubinsky et al.

[11] Patent Number: 6,021,377

[45] Date of Patent: Feb. 1, 2000

[54] DRILLING SYSTEM UTILIZING DOWNHOLE DYSFUNCTIONS FOR DETERMINING CORRECTIVE ACTIONS AND SIMULATING DRILLING CONDITIONS

[75] Inventors: Vladimir Dubinsky; James V. Leggett, III, both of Houston, Tex.

[73] Assignee: Baker Hughes Incorporated, Houston, Tex.

[21] Appl. No.: 08/735,862

[22] Filed: Oct. 23, 1996

Related U.S. Application Data

[60] Provisional application No. 60/005,844, Oct. 23, 1995.

[51] Int. Cl.[7] ..... G06F 19/00

[52] U.S. Cl. ..... 702/9

[58] Field of Search ..... 702/9, 16; 175/24, 175/25, 27, 39, 45, 48, 50; 367/81, 92, 83; 73/152, 46, 152.47, 152.48; 340/853.3, 853.4, 853.5, 853.6

[56] References Cited

U.S. PATENT DOCUMENTS

| | | | |
|---|---|---|---|
| 3,497,019 | 2/1970 | Ortloff . | |
| 4,430,892 | 2/1984 | Owings | 702/9 |
| 4,575,261 | 3/1986 | Berger et al. | 702/9 |
| 4,662,458 | 5/1987 | Ho . | |
| 4,695,957 | 9/1987 | Peltier . | |
| 4,794,534 | 12/1988 | Millheim . | |
| 4,854,397 | 8/1989 | Warren et al. . | |
| 4,903,245 | 2/1990 | Close et al. | 702/9 |
| 4,972,703 | 11/1990 | Ho . | |
| 5,064,006 | 11/1991 | Waters et al. . | |
| 5,163,521 | 11/1992 | Pustanyk et al. . | |
| 5,230,387 | 7/1993 | Waters et al. . | |
| 5,250,806 | 10/1993 | Rhein-Knudsen et al. . | |

(List continued on next page.)

FOREIGN PATENT DOCUMENTS 2 247 477 3/1992 United Kingdom .

OTHER PUBLICATIONS

"Well–site analysis headed for economy, new capabilities." *The Oil and Gas Journal,* pp. 132,133,136 &141 (Sep. 24, 1973).

Hutchinson, et al., AN MWD "Downhole Assistant Driller." *Society of Petroleum Engineers,* pp. 743–752 (Oct. 1995).

J. D. Barr, et al. "Steerable Rotary Drilling With an Experimental System." *Society of Petroleum Engineers,* pp. 435–450 (1995).

*Primary Examiner*—Donald E. McElheny, Jr.
*Attorney, Agent, or Firm*—Madan & Morris, P.C.

[57] ABSTRACT

The present invention provides a closed-loop system for drilling boreholes. The system includes a drill string having a drill bit, a plurality of sensors for providing signals relating to the drill string and formation parameters, a downhole device which processes various downhole sensors signals and computes dysfunctions relating to the drilling operations and transmits such dysfunctions to a surface control unit. The surface control unit determines the relative severity of such dysfunctions and the corrective action required to alleviate such dysfunctions based on programmed instruction and then displays the nature and extent of such dysfunctions and the required corrective action as a display for use by the operator. The programmed instructions may contain models, algorithms and information from prior drilled boreholes, geological information about subsurface formations and the borehole drill path. In an alternative embodiment, the present invention provides an interactive system which displays dynamic drilling parameters for a variety of subsurface formations and downhole operating conditions for a number of different drill string combinations. The system is adapted to allow an operator to simulate drilling conditions for different formations and drilling equipment combinations. This system displays the extent of various dysfunctions as the operator is simulating the drilling conditions and displays corrective action for the operator to take to optimize drilling during such simulation.

26 Claims, 16 Drawing Sheets

U.S. PATENT DOCUMENTS 5,318,137 6/1994 Johnson et al. .
5,332,048 7/1994 Underwood et al. .
5,341,886 8/1994 Patton .
5,358,059 10/1994 Ho .
5,390,748 2/1995 Goldman .
5,394,951 3/1995 Pringle et al. .
5,410,303 4/1995 Comeau et al. .
5,419,405 5/1995 Patton ..... 175/27
5,467,832 11/1995 Orban et al. .
5,490,569 2/1996 Brotherton et al. .
5,602,541 2/1997 Comeau et al. .

DRILLING SYSTEM UTILIZING DOWNHOLE DYSFUNCTIONS FOR DETERMINING CORRECTIVE ACTIONS AND SIMULATING DRILLING CONDITIONS

CROSS-REFERENCE TO RELATED APPLICATION

This application takes priority from U.S. Provisional patent application, Ser. No. 60/005,844, filed on Oct. 23, 1995.

BACKGROUND OF THE INVENTION

1. Field of the Invention

This invention relates generally to systems for drilling boreholes for the production of hydrocarbons from subsurface formations and more particularly to a closed-loop drilling system which includes a number of devices and sensors for determining the operating condition of the drilling assembly, including the drill bit, a number of formation evaluation devices and sensors for determining the nature and condition of the formation through which the borehole is being drilled and processors for computing certain operating parameters downhole that are communicated to a surface system that displays dysfunctions relating to the downhole operating conditions and provides recommended action for the driller to take to alleviate such dysfunctions so as to optimize drilling of the boreholes. This invention also provides a closed-loop interactive system that simulates downhole drilling conditions and determines drilling dysfunctions for a given well profile, bottom hole assembly, and the values of surface controlled drilling parameters and the corrective action which will alleviate such dysfunctions.

2. Description of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes, to increase the hydrocarbon production and/or to withdraw additional hydrocarbons from the earth's formations. Modern directional drilling systems generally employ a drill string having a bottomhole assembly (BHA) and a drill bit at end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity measuring device to determine the presence of hydrocarbons and water. Additional downhole instruments, known as logging-while-drilling ("LWD") tools, are frequently attached to the drill string to determine the formation geology and formation fluid conditions during the drilling operations.

Pressurized drilling fluid (commonly known as the "mud" or "drilling mud") is pumped into the drill pipe to rotate the drill motor and to provide lubrication to various members of the drill string including the drill bit. The drill pipe is rotated by a prime mover, such as a motor, to facilitate directional drilling and to drill vertical boreholes. The drill bit is typically coupled to a bearing assembly having a drive shaft which in turn rotates the drill bit attached thereto. Radial and axial bearings in the bearing assembly provide support to the radial and axial forces of the drill bit.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill string rotational speed (r.p.m of the surface motor coupled to the drill pipe) and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots which provide a macro picture of the subsurface formations and a pre-planned borehole path. For drilling multiple boreholes in the same formation, the operator also has information about the previously drilled boreholes in the same formation. Additionally, various downhole sensors and associated electronic circuitry deployed in the BHA continually provide information to the operator about certain downhole operating conditions, condition of various elements of the drill string and information about the formation through which the borehole is being drilled.

Typically, the information provided to the operator during drilling includes: (a) borehole pressure and temperature; (b) drilling parameters, such as WOB, rotational speed of the drill bit and/ or the drill string, and the drilling fluid flow rate. In some cases, the drilling operator also is provided selected information about the bottomhole assembly condition (parameters), such as torque, mud motor differential pressure, torque, bit bounce and whirl etc.

The downhole sensor data is typically processed downhole to some extent and telemetered uphole by electromagnetic signal transmission devices or by transmitting pressure pulses through the circulating drilling fluid. Mud-pulse telemetry, however, is more commonly used. Such a system is capable of transmitting only a few (1–4) bits of information per second. Due to such a low transmission rate, the trend in the industry has been to attempt to process greater amounts of data downhole and transmit selected computed results or "answers" uphole for use by the driller for controlling the drilling operations.

Although the quality and type of the information transmitted uphole has greatly improved since the use of microprocessors downhole, the current systems do not provide to the operator information about dysfunctions relating to at least the critical drill string parameters in readily usable form nor do they determine what actions the operator should take during the drilling operation to reduce or prevent the occurrence of such dysfunctions so that the operator can optimize the drilling operations and improve the operating life of the bottomhole assembly. It is, therefore, desirable to have a drilling system which provides the operator simple visual indication of the severity of at least certain critical drilling parameters and the actions the operator should take to change the surface-controlled parameters to improve the drilling efficiency.

A serious concern during drilling is the high failure rate of bottom hole assembly and excessive drill bit wear due to excessive bit bounce, bottomhole assembly whirl, bending of the BHA stick-slip phenomenon, torque, shocks, etc. Excessive values of such drill string parameters and other parameters relating to the drilling operations are referred to as dysfunctions. Many drill string and drill bit failures and other drilling problems can be prevented by properly monitoring the dynamic behavior of the bottom hole assembly and the drill bit while drilling and performing necessary corrections to the drilling parameters in real time. Such a process can significantly decrease the drilling assembly failures, thereby extending the drill string life and improving the overall drilling efficiency, including the rate of penetration.

Recently, patent application PCT/FR92/00730 disclosed the use of a device placed near the drill bit downhole for processing data from certain downhole sensors downhole to determine when the certain drilling malfunctions occur and to transmit such malfunctions uphole. The device processes the drilling data and compiles various diagnostics specific to the global or individual behaviors of the drilling tool, drill string, drilling fluid and communicates these diagnostics to the surface via the telemetry system. The downhole sensor data is processed by applying certain algorithms stored in the device for computing the malfunctions.

Presently, regardless of the type of the borehole being drilled, the operator continually reacts to the specific borehole parameters and performs drilling operations based on such information and the information about other downhole operating parameters, such as the bit bounce, weight on bit, drill string displacement, stall etc. to make decisions about the operator-controlled parameters. Thus, the operators base their drilling decisions upon the above-noted information and experience. Drilling boreholes in a virgin region requires greater preparation and understanding of the expected subsurface formations compared to a region where many boreholes have been successfully drilled. The drilling efficiency can be greatly improved if the operator can simulate the drilling activities for various types of formations. Additionally, further drilling efficiency can be gained by simulating the drilling behavior of the specific borehole to be drilled by the operator.

The present invention addresses the above-noted deficiencies and provides an automated closed-loop drilling system for drilling oilfield wellbores at enhanced rates of penetration and with extended life of downhole drilling assembly. The system includes a drill string having a drill bit, a plurality of sensors for providing signals relating to the drill string and formation parameters, and a downhole device which contains certain sensors, processes the sensor signals to determine dysfunctions relating to the drilling operations and transmits information about dysfunctions to a surface control unit. The surface control unit displays the severity of such dysfunctions, determines a corrective action required to alleviate such dysfunctions based on programmed instruction and then displays the required corrective action on a display for use by the operator.

The present invention also provides an interactive system which displays dynamic drilling parameters for a variety of subsurface formations and downhole operating conditions for a number of different drill string combinations and surface-controlled parameters. The system is adapted to allow an operator to simulate drilling conditions for different formations and drilling equipment combinations. This system displays the severity of dysfunctions as the operator is simulating the drilling conditions and displays corrective action for the operator to take to optimize drilling during such simulation.

SUMMARY OF THE INVENTION

The present invention provides an automated closed-loop drilling system for drilling oilfield wellbores at enhanced rates of penetration and with extended life of downhole drilling assembly. A drilling assembly having a drill bit at an end is conveyed into the wellbore by a suitable tubing such as a drill pipe or coiled tubing. The drilling assembly includes a plurality of sensors for detecting selected drilling parameters and generating data representative of said drilling parameters. A computer comprising at least one processor receives signals representative of the data. A force application device applies a predetermined force on the drill bit (weight on bit) within a range of forces. A force controller controls the operation of the force application device to apply the predetermined force on the bit. A source of drilling fluid under pressure at the surface supplies a drilling fluid into the tubing and thus the drilling assembly. A fluid controller controls the operation of the fluid source to supply a desired predetermined pressure and flow rate of the drilling fluid. A rotator, such as a mud motor or a rotary table rotates the drill bit at a predetermined speed of rotation within a range of rotation speed. A receiver associated with the computer receives signals representative of the data and a transmitter associated with the computer sends control signals directing the force controller, fluid controller and rotator controller to operate the force application device, source of drilling fluid under pressure and rotator to achieve enhanced rates of penetration and extended drilling assembly life.

The present invention provides an automated method for drilling an oilfield wellbore with a drilling system having a drilling assembly that includes a drill bit at an end thereof at enhanced drilling rates and with extended drilling assembly life. The drilling assembly is conveyable by a tubing into the wellbore and includes a plurality of downhole sensors for determining parameters relating to the physical condition of the drilling assembly. The method comprises the steps of: (a) conveying the drilling assembly with the tubing into the wellbore for further drilling the wellbore; (b) initiating drilling of the wellbore with the drilling assembly utilizing a plurality of known initial drilling parameters; (c) determining from the downhole sensors during drilling of the wellbore parameters relating to the condition of the drilling assembly; (d) providing a model for use by the drilling system to compute new value for the drilling parameters that when utilized for further drilling of the wellbore will provide drilling of the wellbore at an enhanced drilling rate and with extended drilling assembly life; and (e) further drilling the wellbore utilizing the new values of the drilling parameters.

The system of the present invention also computes dysfunctions related to the drilling assembly and their respective severity relating to the drilling operations and transmits information about such dysfunctions and/or their severity levels to a surface control unit. The surface control unit determines the relative corrective actions required to alleviate such dysfunctions based on programmed instruction and then displays the nature and extent of such dysfunctions and the corrective action on a display for use by the operator. The programmed instructions contain models, algorithms and information from prior drilled boreholes, geological information about subsurface formations and the borehole drill path.

The present invention also provides an interactive system which displays dynamic drilling parameters for a variety of subsurface formations and downhole operating conditions for a number of different drill string combinations. The system is adapted to allow an operator to simulate drilling conditions for different formations and drilling equipment combinations. This system displays the extent of various dysfunctions as the operator is simulating the drilling conditions and displays corrective action for the operator to take to optimize drilling during such simulation.

The present invention also provides an alternative method for drilling oilfield wellbores which comprises the steps of: (a) determining dysfunctions relating to the drilling of a borehole for a given type of bottom hole assembly, borehole profile and the surface controlled parameters; (b) displaying the dysfunctions on a display; and (c) displaying the corrective actions to be taken to alleviate the dysfunctions.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
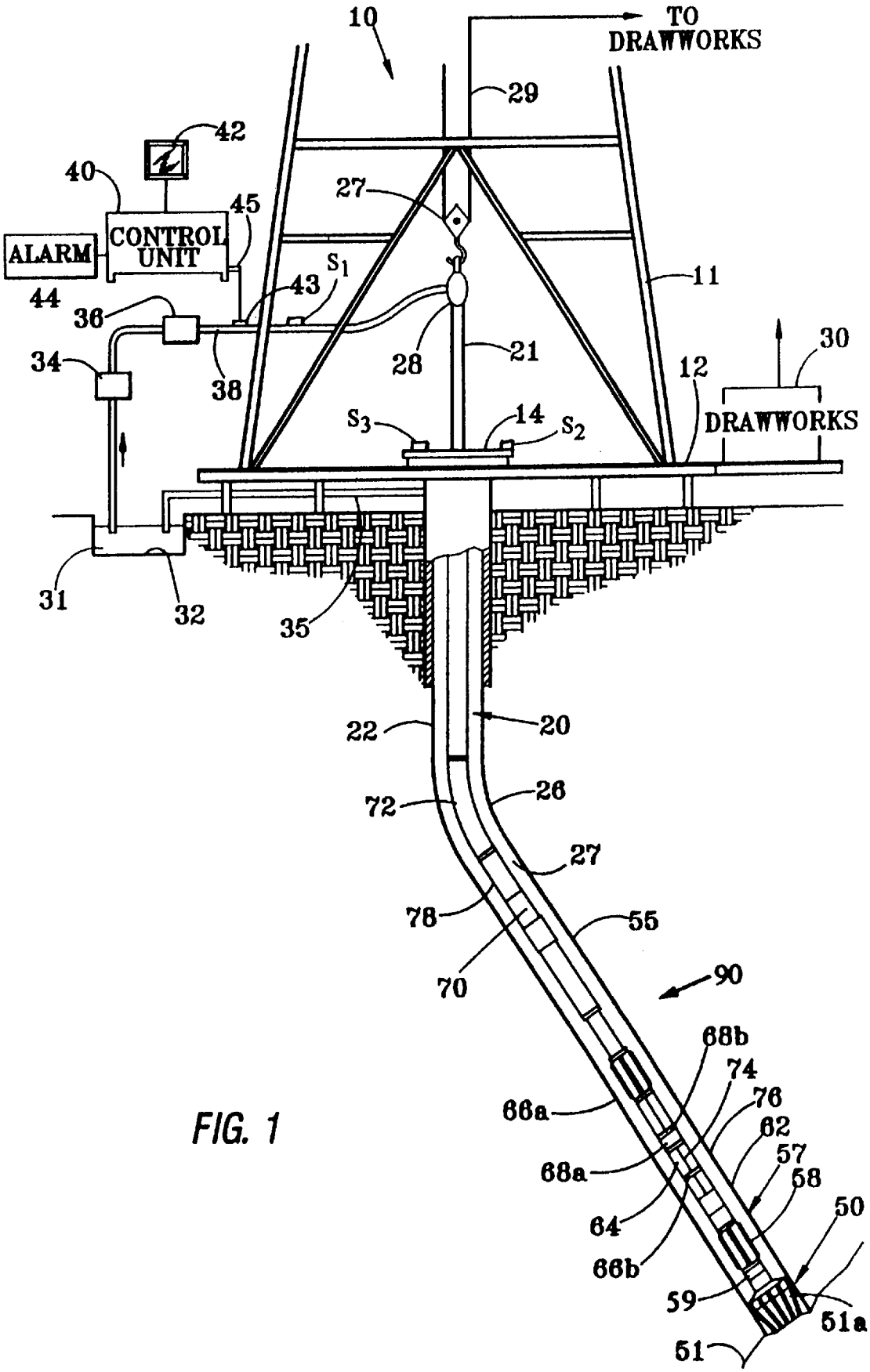
FIG. 1 shows a schematic diagram of a drilling system having a drill string containing a drill bit, mud motor, direction-determining devices, measurement-while-drilling devices and a downhole telemetry system according to a preferred embodiment of the present invention.

In general, the present invention provides a drilling system for drilling oilfield boreholes or wellbores utilizing a drill string having a drilling assembly conveyed downhole by a tubing (usually a drill pipe or coiled tubing). The drilling assembly includes a bottom hole assembly (BHA) and a drill bit. The bottom hole assembly contains sensors for determining the operating condition of the drilling assembly (drilling assembly parameters), sensors for determining the position of the drill bit and the drilling direction (directional parameters), sensors for determining the borehole condition (borehole parameters), formation evaluation sensors for determining characteristics of the formations surrounding the drilling assembly (formation parameters), sensors for determining bed boundaries and other geophysical parameters (geophysical parameters), and sensors in the drill bit for determining the performance and wear condition of the drill bit (drill bit parameters). The system also measures drilling parameters or operations parameters, including drilling fluid flow rate, rotary speed of the drill string, mud motor and drill bit, and weight on bit or the thrust force on the bit.

One or more models, some of which may be dynamic models, are stored downhole and at the surface. A dynamic model is one that is updated based on information obtained during drilling operations and which is then utilized in further drilling of the borehole. Additionally, the downhole processors and the surface control unit contain programmed instructions for manipulating various types of data and interacting with the models. The downhole processors and the surface control unit process data relating to the various types of parameters noted above and utilize the models to determine or compute the drilling parameters for continued drilling that will provide an enhanced rate of penetration and extended drilling assembly life. The system may be activated to activate downhole navigation devices to maintain drilling along a desired wellpath.

Information about certain selected parameters, such as certain dysfunctions relating to the drilling assembly, and the current operating parameters, along with the computed drilling or operations parameters determined by the system, is provided to a drilling operator, preferably in the form of a display on a screen. The system may be programmed to automatically adjust one or more of the drilling parameters to the desired or computed parameters for continued operations. The system may also be programmed so that the operator can override the automatic adjustments and manually adjust the drilling parameters within predefined limits for such parameters. For safety and other reasons, the system is preferably programmed to provide visual and/or audio alarms and/or to shut down the drilling operation if certain predefined conditions exist during the drilling operations.

In one embodiment of the drilling system of the present invention, a subassembly near the drill bit (referred to herein as the "downhole-dynamic-measurement" device or "DDM" device) containing a sufficient number of sensors and circuitry provides data relating to certain drilling assembly dysfunctions during drilling operations. The system also computes the desired drilling parameters for continued operations that will provide improved drilling efficiency in the form of an enhanced rate of penetration with extended drilling assembly life. The system also includes a simulation program which can simulate the effect on the drilling efficiency of changing any one or a combination of the drilling parameters from their current values. The surface computer is programmed to automatically simulate the effect of changing the current drilling parameters on the drilling operations, including the rate of penetration, and the effect on certain parameters relating to the drilling assembly, such as the drill bit wear. Alternatively, the operator can activate the simulator and input the amount of change for the drilling parameters from their current values and determine the corresponding effect on the drilling operations and finally adjust the drilling parameters to improve the drilling efficiency. The simulator model may also be utilized online as described above or off-line to simulate the effect of using different values of the drilling parameters for a given drilling assembly configuration on drilling boreholes along wellpaths through different types of earth formations.

FIG. 1 shows a schematic diagram of a drilling system 10 having a drilling assembly 90 shown conveyed in a borehole 26 for drilling the wellbore. The drilling system 10 includes a conventional derrick 11 erected on a floor 12 which supports a rotary table 14 that is rotated by a prime mover such as an electric motor (not shown) at a desired rotational speed. The drill string 20 includes a drill pipe 22 extending downward from the rotary table 14 into the borehole 26. A drill bit 50, attached to the drill string end, disintegrates the geological formations when it is rotated to drill the borehole 26. The drill string 20 is coupled to a drawworks 30 via a kelly joint 21, swivel 28 and line 29 through a pulley 23. During the drilling operation the drawworks 30 is operated to control the weight on bit, which is an important parameter that affects the rate of penetration. The operation of the drawworks 30 is well known in the art and is thus not described in detail herein.

During drilling operations a suitable drilling fluid 31 from a mud pit (source) 32 is circulated under pressure through the drill string 20 by a mud pump 34. The drilling fluid 31 passes from the mud pump 34 into the drill string 20 via a desurger 36, fluid line 38 and the kelly joint 21. The drilling fluid 31 is discharged at the borehole bottom 51 through an opening in the drill bit 50. The drilling fluid 31 circulates uphole through the annular space 27 between the drill string 20 and the borehole 26 and returns to the mud pit 32 via a return line 35. A sensor $S_1$ preferably placed in the line 38 provides information about the fluid flow rate. A surface torque sensor $S_2$ and a sensor $S_3$ associated with the drill string 20 respectively provide information about the torque and the rotational speed of the drill string. Additionally, a sensor (not shown) associated with line 29 is used to provide the hook load of the drill string 20.

In some applications the drill bit 50 is rotated by only rotating the drill pipe 22. However, in many other applications, a downhole motor 55 (mud motor) is disposed in the drilling assembly 90 to rotate the drill bit 50 and the drill pipe 22 is rotated usually to supplement the rotational power, if required, and to effect changes in the drilling direction. In either case, the rate of penetration (ROP) of the drill bit 50 into the borehole 26 for a given formation and a drilling assembly largely depends upon the weight on bit and the drill bit rotational speed.

In the preferred embodiment of FIG. 1, the mud motor 55 is coupled to the drill bit 50 via a drive shaft (not shown) disposed in a bearing assembly 57. The mud motor 55 rotates the drill bit 50 when the drilling fluid 31 passes through the mud motor 55 under pressure. The bearing assembly 57 supports the radial and axial forces of the drill bit 50, the downthrust of the drill motor and the reactive upward loading from the applied weight on bit. A stabilizer 58 coupled to the bearing assembly 57 acts as a centralizer for the lowermost portion of the mud motor assembly.

A surface control unit 40 receives signals from the downhole sensors and devices via a sensor 43 placed in the fluid line 38 and signals from sensors $S_1$, $S_2$, $S_3$, hook load sensor and any other sensors used in the system and processes such signals according to programmed instructions provided to the surface control unit 40. The surface control unit 40 displays desired drilling parameters and other information on a display/monitor 42 and is utilized by an operator to control the drilling operations. The surface control unit 40 contains a computer, memory for storing data, recorder for recording data and other peripherals. The surface control unit 40 also includes a simulation model and processes data according to programmed instructions and responds to user commands entered through a suitable device, such as a keyboard. The control unit 40 is preferably adapted to activate alarms 44 when certain unsafe or undesirable operating conditions occur. The use of the simulation model is described in detail later.

In one embodiment of the drilling assembly 90, The BHA contains a DDM device 59 preferably in the form of a module or detachable subassembly placed near the drill bit 50. The DDM device 59 contains sensors, circuitry and processing software and algorithms for providing information about desired dynamic drilling parameters relating to the BHA. Such parameters preferably include bit bounce, stick-slip of the BHA, backward rotation, torque, shocks, BHA whirl, BHA buckling, borehole and annulus pressure anomalies and excessive acceleration or stress, and may include other parameters such as BHA and drill bit side forces, and drill motor and drill bit conditions and efficiencies. The DDM device 59 processes the sensor signals to determine the relative value or severity of each such parameter and transmits such information to the surface control unit 40 via a suitable telemetry system 72. The processing of signals and data generated by the sensors in the module 59 is described later in reference to FIG. 5. Drill bit 50 may contain sensors 50*a* for determining drill bit condition and wear.

Referring back to FIG. 1, the BHA also preferably contains sensors and devices in addition to the above-described sensors. Such devices include a device for measuring the formation resistivity near and/or in front of the drill bit, a gamma ray device for measuring the formation gamma ray intensity and devices for determining the inclination and azimuth of the drill string.

The formation resistivity measuring device 64 is preferably coupled above the lower kick-off subassembly 62 that provides signals from which resistivity of the formation near or in front of the drill bit 50 is determined. One resistivity measuring device is described in U.S. Pat. No. 5,001,675, which is assigned to the assignee hereof and is incorporated herein by reference. This patent describes a dual propagation resistivity device ("DPR") having one or more pairs of transmitting antennae 66*a* and 66*b* spaced from one or more pairs of receiving antennae 68*a* and 68*b*. Magnetic dipoles are employed which operate in the medium frequency and lower high frequency spectrum. In operation, the transmitted electromagnetic waves are perturbed as they propagate through the formation surrounding the resistivity device 64. The receiving antennas 68*a* and 68*b* detect the perturbed waves. Formation resistivity is derived from the phase and amplitude of the detected signals. The detected signals are processed by a downhole circuit that is preferably placed in a housing 70 above the mud motor 55 and transmitted to the surface control unit 40 using a suitable telemetry system 72.

The inclinometer 74 and gamma ray device 76 are suitably placed along the resistivity measuring device 64 for respectively determining the inclination of the portion of the drill string near the drill bit 50 and the formation gamma ray intensity. Any suitable inclinometer and gamma ray device, however, may be utilized for the purposes of this invention. In addition, an azimuth device (not shown), such as a magnetometer or a gyroscopic device, may be utilized to determine the drill string azimuth. Such devices are known in the art and therefore are not described in detail herein. In the above-described configuration, the mud motor 55 transfers power to the drill bit 50 via one or more hollow shafts that run through the resistivity measuring device 64. The hollow shaft enables the drilling fluid to pass from the mud motor 55 to the drill bit 50. In an alternate embodiment of the drill string 20, the mud motor 55 may be coupled below resistivity measuring device 64 or at any other suitable place.

U.S. Pat. No. 5,325,714, assigned to the assignee hereof, which is incorporated herein by reference, discloses placement of a resistivity device between the drill bit 50 and the mud motor 55. The above described resistivity device, gamma ray device and the inclinometer are preferably placed in a common housing that may be coupled to the motor in the manner described in U.S. Pat. No. 5,325,714. Additionally, U.S. patent application Ser. No. 08/212,230, assigned to the assignee hereof, which is incorporated herein by reference, discloses a modular system wherein the drill string contains modular assemblies including a modular sensor assembly, motor assembly and kick-off subs. The modular sensor assembly is disposed between the drill bit and the mud motor as described herein above. The present preferably utilizes the modular system as disclosed in U.S. Ser. No. 08/212,230.

Still referring to FIG. 1, logging-while-drilling devices, such as devices for measuring formation porosity, permeability and density, may be placed above the mud motor 64 in the housing 78 for providing information useful for evaluating and testing subsurface formations along borehole 26. U.S. Pat. No. 5,134,285, which is assigned to the assignee hereof, which is incorporated herein by reference, discloses a formation density device that employs a gamma ray source and a detector. In use, gamma rays emitted from the source enter the formation where they interact with the formation and attenuate. The attenuation of the gamma rays is measured by a suitable detector from which density of the formation is determined.

The present system preferably utilizes a formation porosity measurement device, such as that disclosed in U.S. Pat. No. 5,144,126 which is assigned to the assignee hereof and which is incorporated herein by reference, which employs a neutron emission source and a detector for measuring the resulting gamma rays. In use, high energy neutrons are emitted into the surrounding formation. A suitable detector measures the neutron energy delay due to interaction with hydrogen atoms present in the formation. Other examples of nuclear logging devices are disclosed in U.S. Pat. Nos. 5,126,564 and 5,083,124.

The above-noted devices transmit data to the downhole telemetry system 72, which in turn transmits the received data uphole to the surface control unit 40. The downhole telemetry system 72 also receives signals and data from the uphole control unit 40 and transmits such received signals and data to the appropriate downhole devices. The present invention preferably utilizes a mud pulse telemetry technique to communicate data from downhole sensors and devices during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. Other telemetry techniques, such as electromagnetic and acoustic techniques or any other suitable technique, may be utilized for the purposes of this invention.

The drilling system described thus far relates to those drilling systems that utilize a drill pipe to conveying the drilling assembly 90 into the borehole 26, wherein the weight on bit, one of the important drilling parameters, is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the required to force on the drill bit. For the purpose of this invention, the term weight on bit is used to denote the force on the bit applied to the drill bit during drilling operation, whether applied by adjusting the weight of the drill string or by thrusters or by any other method. Also, when coiled-tubing is utilized the tubing is not rotated by a rotary table, instead it is injected into the wellbore by a suitable injector while the downhole motor, such as mud motor 55, rotates the drill bit 50.

A number of sensors are also placed in the various individual devices in the drilling assembly. For example, a variety of sensors are placed in the mud motor, bearing assembly, drill shaft, tubing and drill bit to determine the condition of such elements during drilling and the borehole parameters. The preferred manner of deploying certain sensors in the various drill string elements will now be described.

Figure 2A:
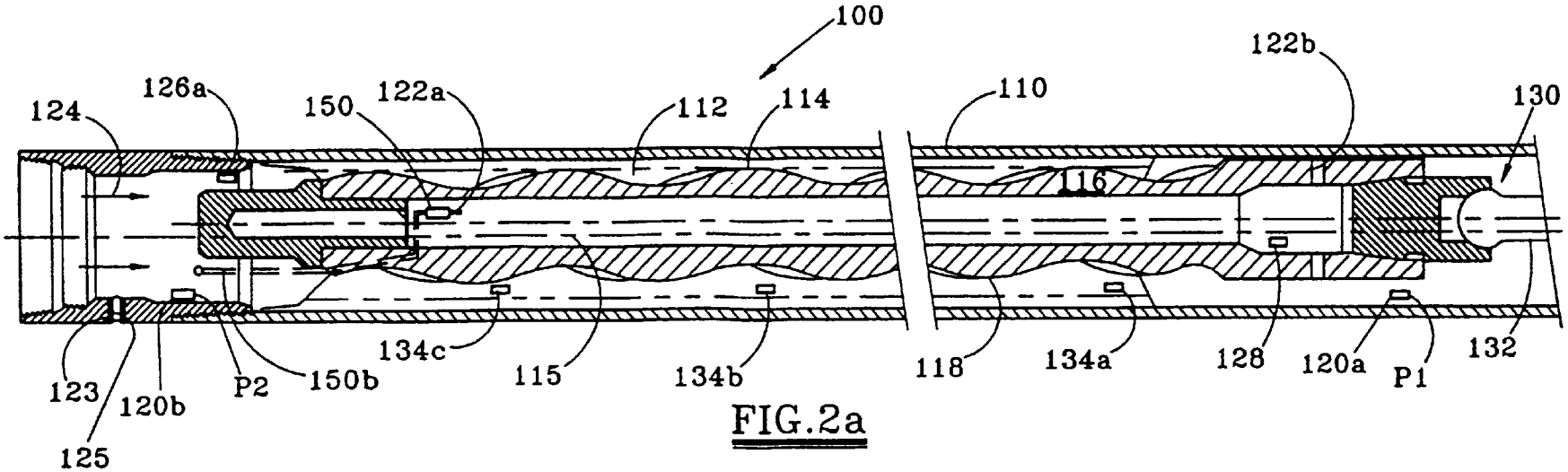
FIGS. 2*a*–2*b* show a longitudinal cross-section of a motor assembly having a mud motor and a non-sealed or mud-lubricated bearing assembly and the preferred manner of placing certain sensors in the motor assembly for continually measuring certain motor assembly operating parameters according to the present invention.
Figure 2B:
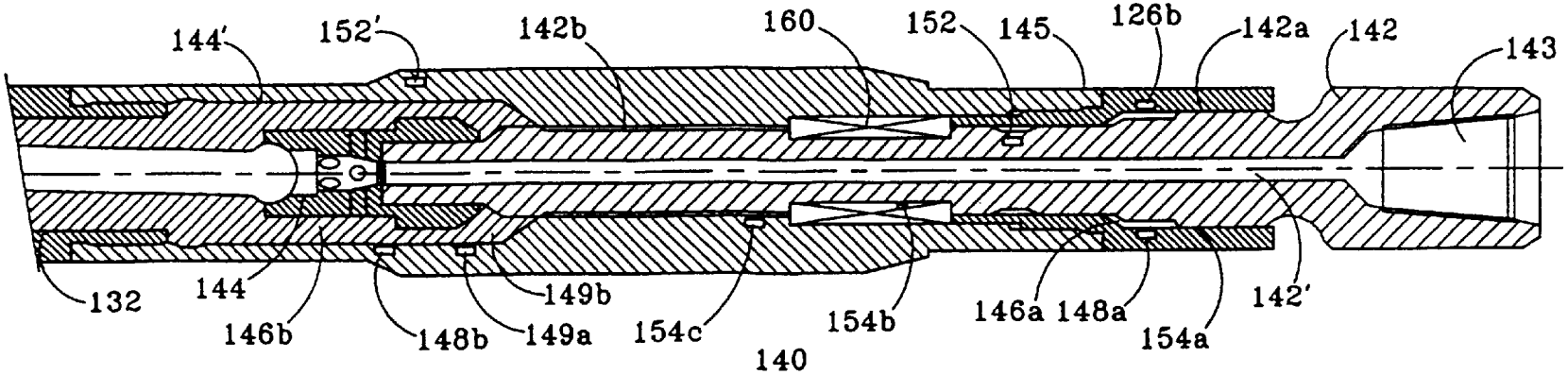

The preferred method of mounting various sensors for determining the motor assembly parameters and the method for controlling the drilling operations in response to such parameters will now be described in detail while referring to FIGS. 2*a*–4. FIGS. 2*a*–2*b* show a cross-sectional elevation view of a positive displacement mud motor power section 100 coupled to a mud-lubricated bearing assembly 140 for use in the drilling system 10. The power section 100 contains an elongated housing 110 having therein a hollow elastomeric stator 112 which has a helically-lobed inner surface 114. A metal rotor 116, preferably made from steel, having a helically-lobed outer surface 118 is rotatably disposed inside the stator 112. The rotor 116 preferably has a non-through bore 115 that terminates at a point 122*a* below the upper end of the rotor as shown in FIG. 2*a*. The bore 115 remains in fluid communication with the fluid below the rotor via a port 122*b*. Both the rotor and stator lobe profiles are similar, with the rotor having one less lobe than the stator. The rotor and stator lobes and their helix angles are such that rotor and stator seal at discrete intervals resulting in the creation of axial fluid chambers or cavities which are filled by the pressurized drilling fluid.

The action of the pressurized circulating fluid flowing from the top to bottom of the motor, as shown by arrows 124, causes the rotor 116 to rotate within the stator 112. Modification of lobe numbers and geometry provides for variation of motor input and output characteristics to accommodate different drilling operations requirements.

Still referring to FIGS. 2*a*–2*b*, a differential pressure sensor 150 preferably disposed in line 115 senses at its one end pressure of the fluid 124 before it passes through the mud motor via a fluid line 150*a* and at its other end the pressure in the line 115, which is the same as the pressure of the drilling fluid after it has passed around the rotor 116. The differential pressure sensor thus provides signals representative of the pressure differential across the rotor 116. Alternatively, a pair of pressure sensors $P_1$ and $P_2$ may be disposed a fixed distance apart, one near the bottom of the rotor at a suitable point 120*a* and the other near the top of the rotor at a suitable point 120*b*. Another differential pressure sensor 122 (or a pair of pressure sensors) may be placed in an opening 123 made in the housing 110 to determine the pressure differential between the fluid 124 flowing through the motor 110 and the fluid flowing through the annulus 27 (see FIG. 1) between the drill string and the borehole.

To measure the rotational speed of the rotor downhole and thus the drill bit 50, a suitable sensor 126*a* is coupled to the power section 100. A vibration sensor, magnetic sensor, Hall-effect sensor or any other suitable sensor may be utilized for determining the motor speed. Alternatively, a sensor 126*b* may be placed in the bearing assembly 140 for monitoring the rotational speed of the motor (see FIG. 2*b*). A sensor 128 for measuring the rotor torque is preferably placed at the rotor bottom. In addition, one or more temperature sensors may be suitably disposed in the power section 100 to continually monitor the temperature of the stator 112. High temperatures may result due to the presence of high friction of the moving parts. High stator temperature can deteriorate the elastomeric stator and thus reduce the operating life of the mud motor. In FIG. 2*a* three spaced temperature sensors 134*a*–*c* are shown disposed in the stator 112 for monitoring the stator temperature.

Each of the above-described sensors generates signals representative of its corresponding mud motor parameter, which signals are transmitted to the downhole control circuit placed in section 70 of the drill string 20 via hard wires coupled between the sensors and the control circuit or by magnetic or acoustic coupling devices known in the art or by any other desirable manner for further processing of such signals and the transmission of the processed signals and data uphole via the downhole telemetry. U.S. Pat. No. 5,160,925, assigned to the assignee hereof, which is incorporated herein by reference, discloses a modular communication link placed in the drill string for receiving data from the various sensors and devices and transmitting such data upstream. The system of the present invention may also utilize such a communication link for transmitting sensor data to the control circuit or the surface control system.

The mud motor's rotary force is transferred to the bearing assembly 140 via a rotating shaft 132 coupled to the rotor 116. The shaft 132 disposed in a housing 130 eliminates all rotor eccentric motions and the effects of fixed or bent adjustable housings while transmitting torque and downthrust to the drive sub 142 of the bearing assembly 140. The type of the bearing assembly used depends upon the particular application. However, two types of bearing assemblies are most commonly used in the industry: a mud-lubricated bearing assembly such as the bearing assembly 140 shown in FIG. 2*a*, and a sealed bearing assembly, such as bearing assembly 170 shown in FIG. 2*c*.

Referring back to FIG. 2*b*, a mud-lubricated bearing assembly typically contains a rotating drive shaft 142 disposed within an outer housing 145. The drive shaft 142 terminates with a bit box 143 at the lower end that accommodates the drill bit 50 (see FIG. 1) and is coupled to the shaft 132 at the upper end 144 by a suitable joint 144'. The drilling fluid from the power section 100 flows to the bit box 143 via a through hole 142' in the drive shaft 142. The radial movement of the drive shaft 142 is restricted by a suitable lower radial bearing 142*a* placed at the interior of the housing 145 near its bottom end and an upper radial bearing 142*b* placed at the interior of the housing near its upper end. Narrow gaps or clearances 146*a* and 146*b* are respectively provided between the housing 145 and the vicinity of the lower radial bearing 142*a* and the upper radial bearing 142*b* and the interior of the housing 145. The radial clearance between the drive shaft and the housing interior varies approximately between 0.150 mm to 0.300 mm depending upon the design choice.

During the drilling operations, the radial bearings, such as shown in FIG. 2*b*, start to wear down causing the clearance to vary. Depending upon the design requirement, the radial bearing wear can cause the drive shaft to wobble, making it difficult for the drill string to remain on the desired course and in some cases can cause the various parts of the bearing assembly to become dislodged. Since the lower radial bearing 142*a* is near the drill bit, even a relatively small increase in the clearance at the lower end can reduce the drilling efficiency. To continually measure the clearance between the drive shaft 142 and the housing interior, displacement sensors 148*a* and 148*b* are respectively placed at suitable locations on the housing interior. The sensors are positioned to measure the movement of the drive shaft 142 relative to the inside of the housing 145. Signals from the displacement sensors 148*a* and 148*b* may be transmitted to the downhole control circuit by conductors placed along the housing interior (not shown) or by any other manner described above in reference to FIGS. 2*a*.

Still referring to FIG. 2*b*, a thrust bearing section 160 is provided between the upper and lower radial bearings to control the axial movement of the drive shaft 142. The thrust bearings 160 support the downthrust of the rotor 116, downthrust due to fluid pressure drop across the bearing assembly 140 and the reactive upward loading from the applied weight on bit. The drive shaft 142 transfers both the axial and torsional loading to the drill bit coupled to the bit box 143. If the clearance between the housing and the drive shaft has an inclining gap, such as shown by numeral 149, then the same displacement sensor 149*a* may be used to determine both the radial and axial movements of the drive shaft 142. Alternatively, a displacement sensor may be placed at any other suitable place to measure the axial movement of the drive shaft 142. High precision displacement sensors suitable for use in borehole drilling are commercially available and, thus, their operation is not described in detail. From the discussion thus far, it should be obvious that weight on bit is an important control parameter for drilling boreholes. A load sensor 152, such as a strain gauge, is placed at a suitable place in the bearing assembly 142 (downstream of the thrust bearings 160) to continuously measure the weight on bit. Alternatively, a sensor 152' may be placed in the bearing assembly housing 145 (upstream of the thrust bearings 160) or in the stator housing 110 (see FIG. 2*a*) to monitor the weight on bit.

Figure 2C:
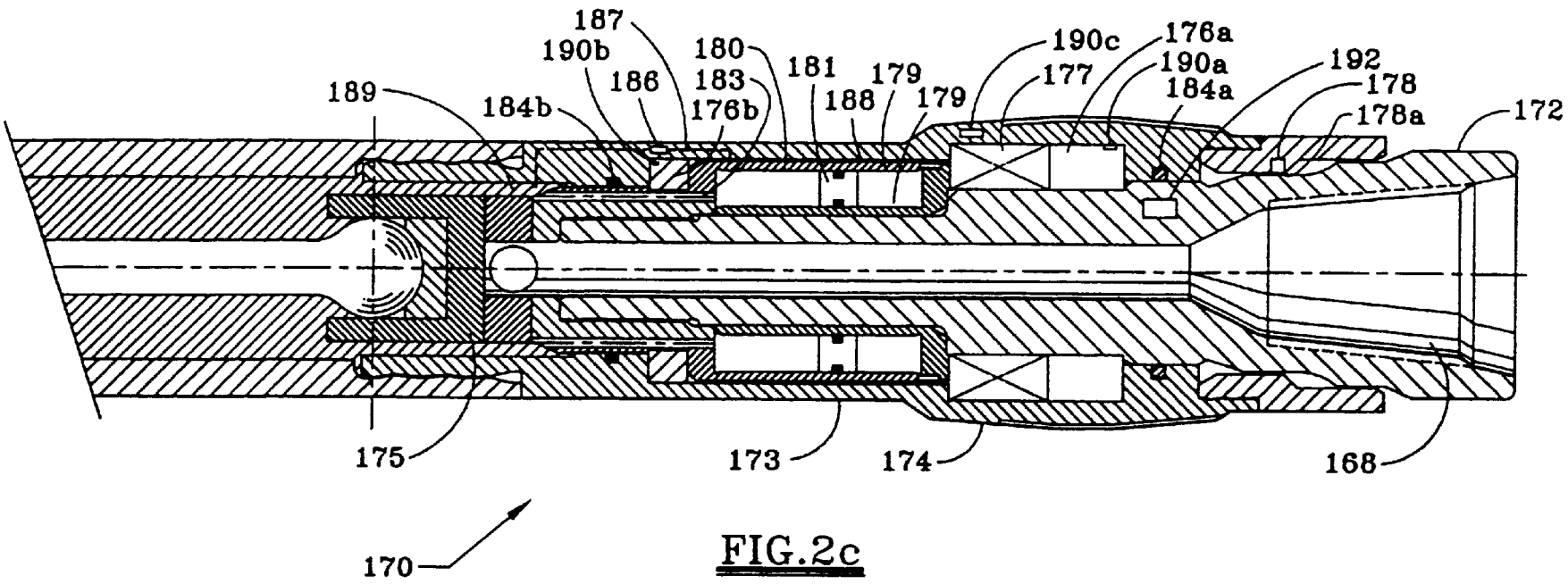
FIGS. 2*c* shows a longitudinal cross-section of a sealed bearing assembly and the preferred manner of the placement of certain sensors thereon for use with the mud motor shown in FIG. 2*a*.

Sealed bearing assemblies are typically utilized for precision drilling and have much tighter tolerances compared to the mud-lubricated bearing assemblies. FIG. 2*c* shows a sealed bearing assembly 170, which contains a drive shaft 172 disposed in a housing 173. The drive shaft is coupled to the motor shaft via a suitable universal joint 175 at the upper end and has a bit box 168 at the bottom end for accommodating a drill bit. Lower and upper radial bearings 176*a* and 176*b* provide radial support to the drive shaft 172 while a thrust bearing 177 provides axial support. One or more suitably placed displacement sensors may be utilized to measure the radial and axial displacements of the drive shaft 172. For simplicity and not as a limitation, in FIG. 2*c* only one displacement sensor 178 is shown to measure the drive shaft radial displacement by measuring the amount of clearance 178*a*.

As noted above, sealed-bearing-type drive subs have much tighter tolerances (as low as 0.001" radial clearance between the drive shaft and the outer housing) and the radial and thrust bearings are continuously lubricated by a suitable working oil 179 placed in a cylinder 180. Lower and upper seals 184*a* and 184*b* are provided to prevent leakage of the oil during the drilling operations. However, due to the hostile downhole conditions and the wearing of various components, the oil frequently leaks, thus depleting the reservoir 180, thereby causing bearing failures. To monitor the oil level, a differential pressure sensor 186 is placed in a line 187 coupled between an oil line 188 and the drilling fluid 189 to provide the difference in the pressure between the oil pressure and the drilling fluid pressure. Since the differential pressure for a new bearing assembly is known, reduction in the differential pressure during the drilling operation may be used to determine the amount of the oil remaining in the reservoir 180. Additionally, temperature sensors 190*a–c* may be placed in the bearing assembly sub 170 to respectively determine the temperatures of the lower and upper radial bearings 176*a–b* and thrust bearings 177. Also, a pressure sensor 192 is preferably placed in the fluid line in the drive shaft 172 for determining the weight on bit. Signals from the differential pressure sensor 186, temperature sensors 190*a–c,* pressure sensor 192 and displacement sensor 178 are transmitted to the downhole control circuit in the manner described earlier in relation to FIG. 2*a*.

Figure 3:
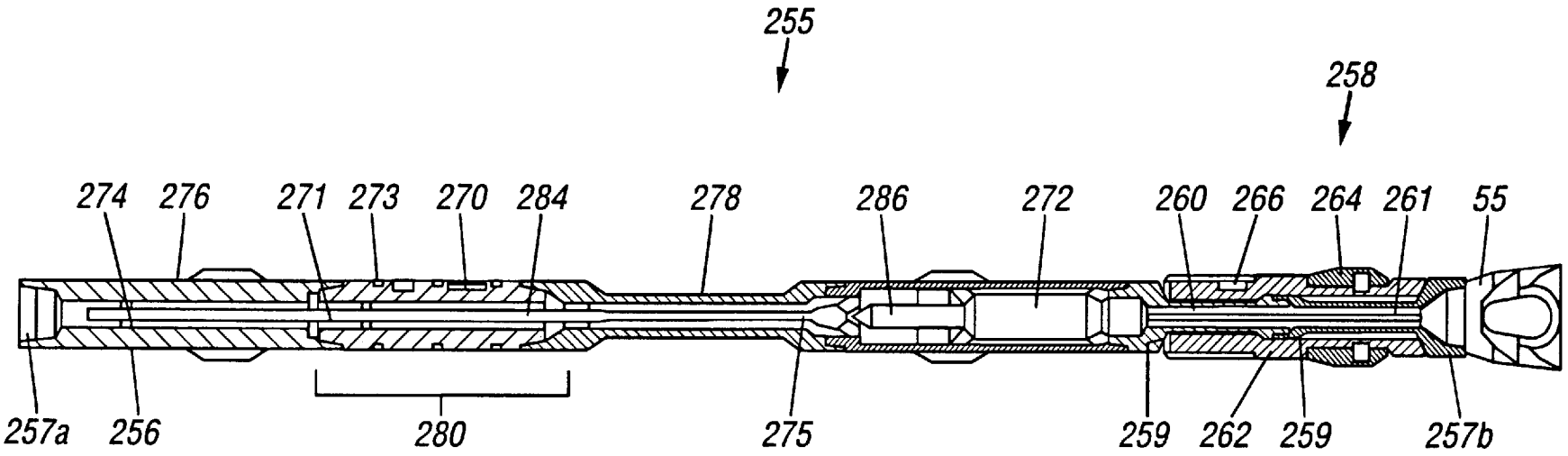
FIG. 3 shows a schematic diagram of a drilling assembly for use with a surface rotary system for drilling boreholes, wherein the drilling assembly has a non-rotating collar for effecting directional changes downhole.

FIG. 3 shows a schematic diagram of a rotary drilling assembly 255 conveyable downhole by a drill pipe (not shown) that includes a device for changing drilling direction without stopping the drilling operations for use in the drilling system 10 shown in FIG. 1. The drilling assembly 255 has an outer housing 256 with an upper joint 257*a* for connection to the drill pipe (not shown) and a lower joint 257*b* for accommodating a drill bit 55. During drilling operations the housing, and thus the drill bit 55, rotate when the drill pipe is rotated by the rotary table at the surface. The lower end 258 of the housing 256 has reduced outer dimensions 258 and a bore 259 therethrough. The reduced-dimensioned end 258 has a shaft 260 that is connected to the lower end 257*b* and a passage 261 for allowing the drilling fluid to pass to the drill bit 55. A non-rotating sleeve 262 is disposed on the outside of the reduced dimensioned end 258, in that when the housing 256 is rotated to rotate the drill bit 55, the non-rotating sleeve 262 remains in its position. A plurality of independently adjustable or expandable stabilizers 264 are disposed on the outside of the non-rotating sleeve 262. Each stabilizer 264 is preferably hydraulically operated by a control unit in the drilling assembly 255. By selectively extending or retracting the individual stabilizers 264 during the drilling operations, the drilling direction can be substantially continuously and relatively accurately controlled. An inclination device 266, such as one or more magnetometers and gyroscopes, are preferably disposed on the non-rotating sleeve 262 for determining the inclination of the sleeve 262. A gamma ray device 270 and any other device may be utilized to determine the drill bit position during drilling, preferably the x, y, and z axis of the drill bit 55. An alternator and oil pump 272 are preferably disposed uphole of the sleeve 262 for providing hydraulic power and electrical power to the various downhole components, including the stabilizers 264. Batteries 274 for storing and providing electric power downhole are disposed at one or more suitable places in the drilling assembly 255.

The drilling assembly 255, like the drilling assembly 90 shown in FIG. 1, may include any number of devices and sensors to perform other functions and provide the required data about the various types of parameters relating to the drilling system described herein. The drilling assembly 255 preferably includes a resistivity device for determining the resistivity of the formations surrounding the drilling assembly, other formation evaluation devices, such as porosity and density devices (not shown), a directional sensor 271 near the upper end 257*a* and sensors for determining the temperature, pressure, fluid flow rate, weight on bit, rotational speed of the drill bit, radial and axial vibrations, shock, and whirl. The drilling assembly may also include position sensitive sensors for determining the drill string position relative to the borehole walls. Such sensors may be selected from a group comprising acoustic stand off sensors, calipers, electromagnetic, and nuclear sensors.

The drilling assembly 255 preferably includes a number of non-magnetic stabilizers 276 near the upper end 257*a* for providing lateral or radial stability to the drill string during drilling operations. A flexible joint 278 is disposed between the section 280 containing the various above-noted formation evaluation devices and the non-rotating sleeve 262. The drilling assembly 256 which includes a control unit or circuits having one or more processors, generally designated herein by numeral 284, processes the signals and data from the various downhole sensors. Typically, the formation evaluation devices include dedicated electronics and processors as the data processing need during the drilling can be relatively extensive for each such device. Other desired electronic circuits are also included in the section 280. The processing of signals is performed generally in the manner described below in reference to FIG. 4. A telemetry device, in the form of an electromagnetic device, an acoustic device, a mud-pulse device or any other suitable device, generally designated herein by numeral 286 is disposed in the drilling assembly 255 at a suitable place.

Figure 4:
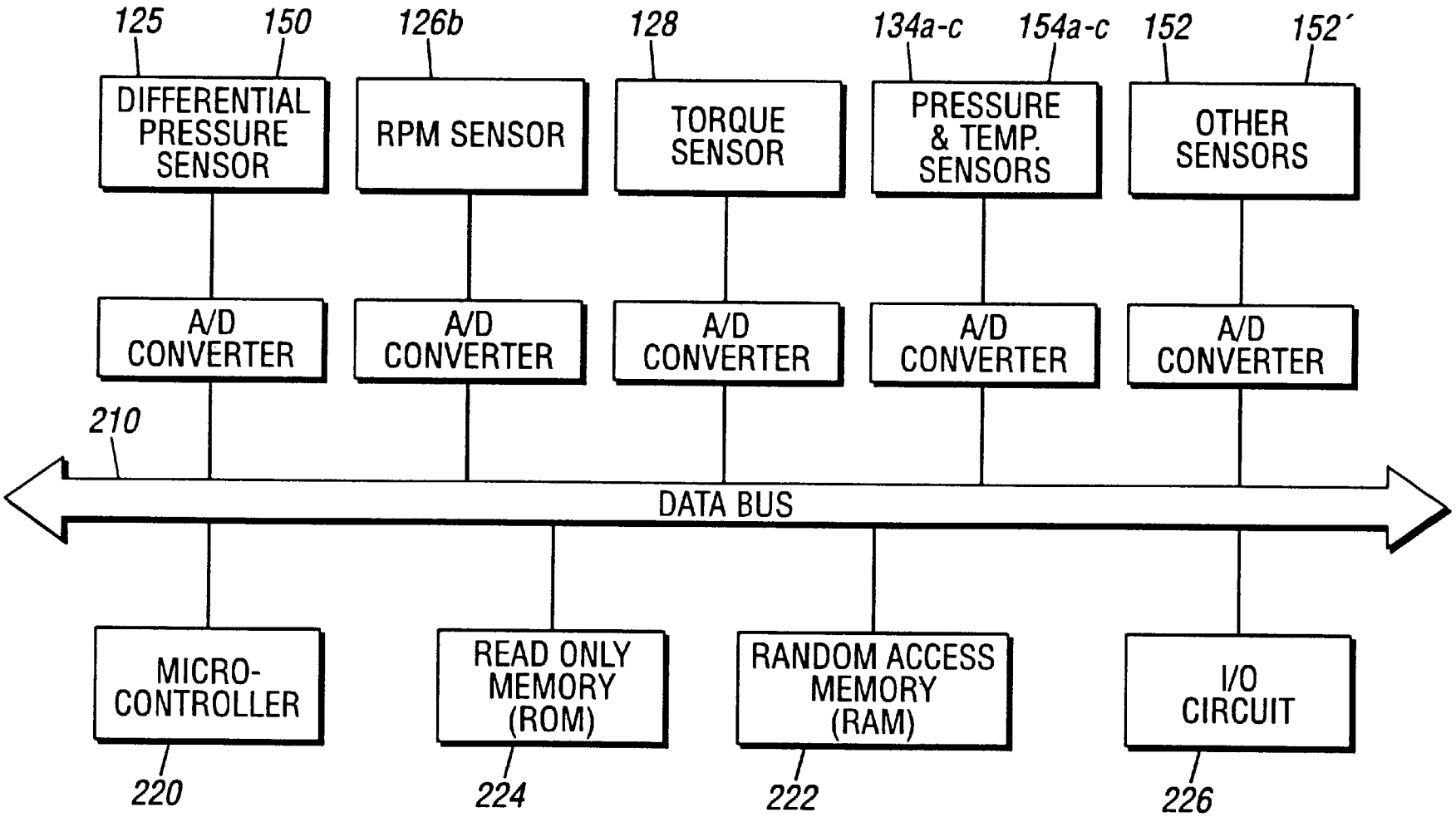
FIG. 4 shows a block circuit diagram for processing signals relating to certain downhole sensor signals for use in the bottom hole assembly used in the drilling system shown in FIG. 1.

FIG. 4 shows a block circuit diagram of a portion of an exemplary circuit that may be utilized to perform signal processing, data analysis and communication operations relating to the motor sensor and other drill string sensor signals. The differential pressure sensors 125 and 150, sensor pair P1 and P2, RPM sensor 126*b,* torque sensor 128, temperature sensors 134*a–c* and 154*a–c,* drill bit sensors 50*a,* WOB sensor 152 or 152' and other sensors utilized in the drill string 20, provide analog signals representative of the parameter measured by such sensors. The analog signals from each such sensor are amplified and passed to an associated analog-to-digital (A/D) converter which provides a digital output corresponding to its respective input signal. The digitized sensor data is passed to a data bus 210. A micro-controller 220 coupled to the data bus 210 processes the sensor data downhole according to programmed instruction stored in a read only memory (ROM) 224 coupled to the data bus 210. A random access memory (RAM) 222 coupled to the data bus 210 is utilized by the micro-controller 220 for downhole storage of the processed data. The micro-controller 220 communicates with other downhole circuits via an input/output (I/O) circuit 226 (telemetry). The processed data is sent to the surface control unit 40 (see FIG. 1) via the downhole telemetry 72. For example, the micro-controller can analyze motor operation downhole, including stall, underspeed and overspeed conditions as may occur in two-phase underbalance drilling and communicate such conditions to the surface unit via the telemetry system. The micro-controller 220 may be programmed to (a) record the sensor data in the memory 222 and facilitate communication of the data uphole, (b) perform analyses of the sensor data to compute answers and detect adverse conditions, (c) actuate downhole devices to take corrective actions, (d) communicate information to the surface, (f) transmit command and/or alarm signals uphole to cause the surface control unit 40 to take certain actions, (g) provide to the drilling operator information for the operator to take appropriate actions to control the drilling operations.

Figure 5:
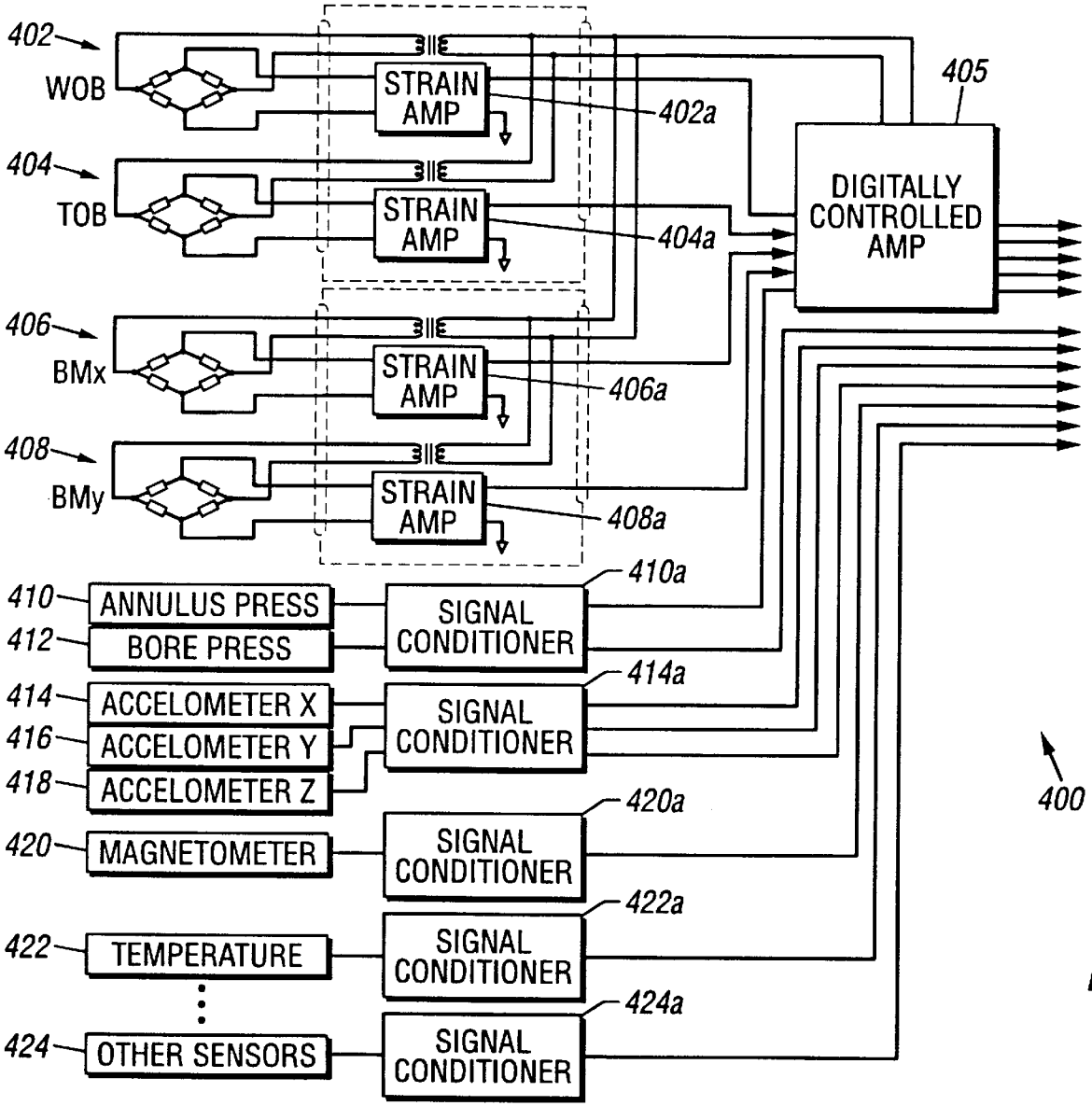
FIG. 5 shows a block circuit diagram for processing signals relating to certain downhole sensor signals for use in the bottomhole assembly used in the drilling system shown in FIG. 1.
Figure 5:
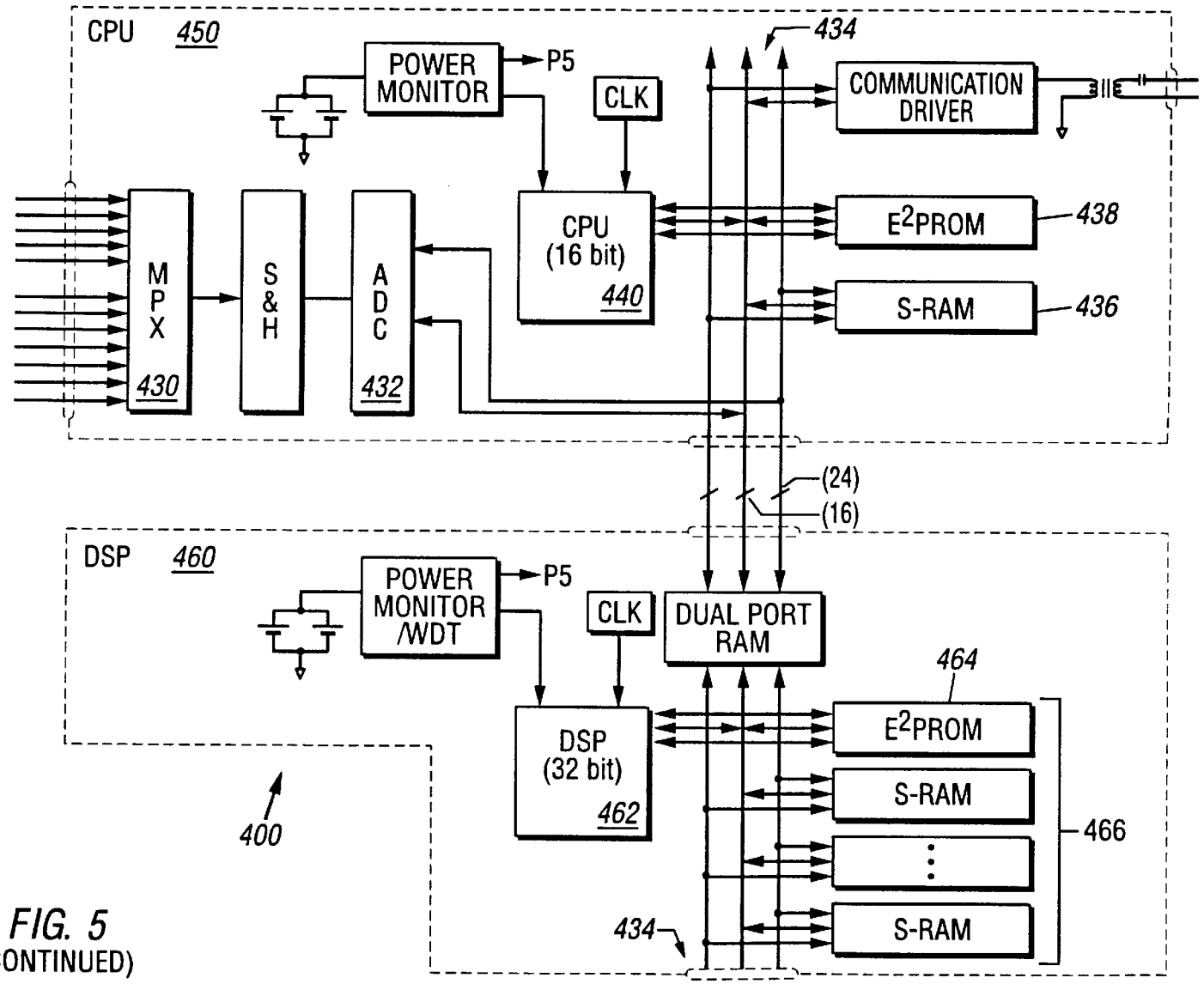

FIG. 5 shows a preferred block circuit diagram for processing signals from the various sensors in the DDM device 59 (FIG. 1) and for telemetering the severity or the relative level of the associated drilling parameters computed according to programmed instructions stored downhole. As shown in FIG. 2, the analog signals relating to the WOB from the WOB sensor 402 (such as a strain gauge) and the torque-on-bit sensor 404 (such as a strain gauge) are amplified by their associated strain gauge amplifiers 402*a* and 404*a* and fed to a digitally-controlled amplifier 405 which digitizes the amplified analog signals and feeds the digitized signals to a multiplexer 430 of a CPU circuit 450. Similarly, signals from strain gauges 406 and 408 respectively relating to orthogonal bending moment components BMy and BMx are processed by their associated signal conditioners 406*a* and 408*a,* digitized by the digitally-controlled amplifier 405 and then fed to the multiplexer 430. Additionally, signals from borehole annulus pressure sensor 410 and drill string bore pressure sensor 412 are processed by an associated signal conditioner 410*a* and then fed to the multiplexer 430. Radial and axial accelerometer sensors 414, 416 and 418 provide signals relating to the BHA vibrations, which are processed by the signals conditioner 414*a* and fed to the multiplexer 430. Additionally, signals from magnetometer 420, temperature sensor 422 and other desired sensors 424, such as a sensor for measuring the differential pressure across the mud motor, are processed by their respective signal conditioner circuits 420*a*–420*c* and passed to the multiplexer 430.

The multiplexer 430 passes the various received signals in a predetermined order to an analog-to-digital converter (ADC) 432, which converts the received analog signals to digital signals and passes the digitized signals to a common data bus 434. The digitized sensor signals are temporarily stored in a suitable memory 436. A second memory 438, preferably an erasable programmable read only memory (EPROM) stores algorithms and executable instructions for use by a central processing unit (CPU) 440. A digital signal processing circuit 460 (DSP circuit) coupled to the common data bus 434 performs majority of the mathematical calculations associated with the processing of the data associated with the sensors described in reference to FIG. 2. The DSP circuit includes a microprocessor for processing data, a memory 464, preferably in the form of an EPROM, for storing instructions (program) for use by the microprocessor 462, and memory 466 for storing data for use by the microprocessor 462. The CPU 440 cooperates with the DSP circuit via the common bus 434, retrieves the stored data from the memory 436, processes such according to the programmed instructions in the memory 438 and transmits the processed signals to the surface control unit 40 via a communication driver 442 and the downhole telemetry 72 (FIG. 1).

The CPU 440 is preferably programmed to transmit the values of the computed parameters or answers. The value of a parameter defines the relative level or severity of such a parameter. The value of each parameter is preferably divided into a plurality of levels (for example 1–8) and the relative level defines the severity of the drilling condition associated with such a parameter. For example, levels 1–3 for bit torque on bit may be defined as acceptable or no dysfunction, levels 4–6 as an indication of some dysfunction and levels 7–8 as an indication of a severe dysfunction. The severity of other drilling parameters is similarly defined. Due to the severe data transmission rate constraints, the CPU 440 is preferably programmed to transmit uphole only the severity level of each of the parameter. The CPU 440 may also be programmed to rank the dysfunctions in order of their relative negative effect on the drilling performance or by any other desired criterion and then to transmit such dysfunction information in that order. This allows the operator or the system to correct the most severe dysfunction first. Alternately, the CPU 440 may be programmed to transmit signals relating only to the dysfunctions along with the average values of selected downhole parameters, such as the downhole WOB, downhole torque on bit, differential pressure between the annulus and the drill string. No signal may imply no dysfunction.

The present invention provides a model or program that may be utilized with the computer of the surface control unit 40 for displaying the severity of the downhole dysfunctions, determining which surface-controlled parameters should be changed to alleviate such dysfunctions and to enable the operator to simulate the effect of changes in an accelerated mode prior to the changing of the surface controlled parameters. The present invention also provides a model for use on a computer that enables an operator to simulate the drilling conditions for a given BHA device, borehole profile (formation type and inclination) and the set of surface operating parameters chosen. The preferred model for use in the simulator will be described first and then the online application of certain aspects of such a model with the drilling system shown in FIG. 1.

Figure 6:
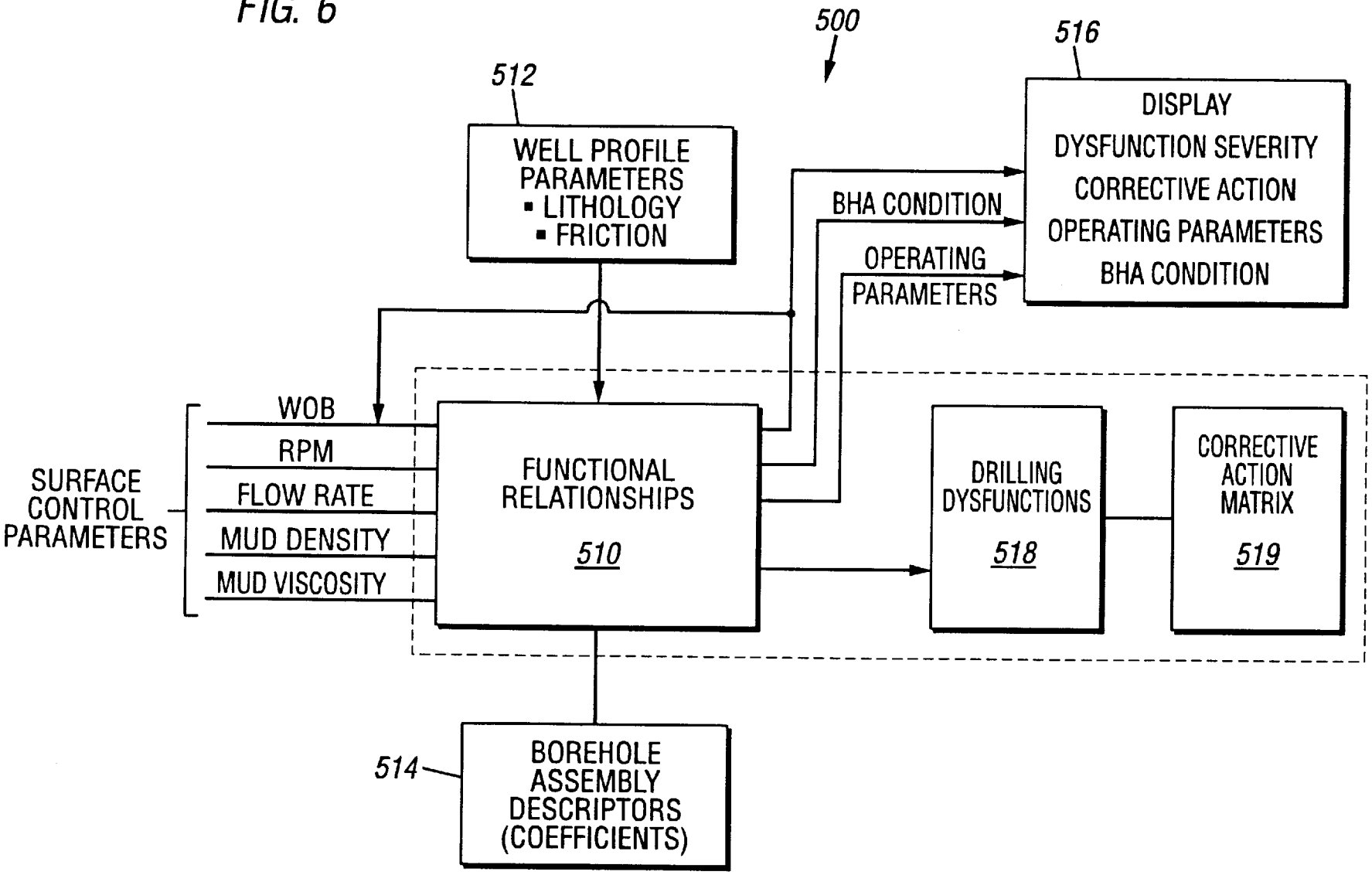
FIG. 6 shows a functional block diagram of an embodiment of a model for determining dysfunctions for use in the present invention.

FIG. 6 show a functional block diagram of the preferred model 500 for use to simulate the downhole drilling conditions and for displaying the severity of drilling dysfunctions, to determine which surface-controlled parameters should be changed to alleviate the dysfunctions. Block 510 contains predefined functional relationships for various parameters used by the model for simulating the downhole drilling operations. Such relationships are more fully described later with reference to FIG. 7. Referring back to FIG. 6, well profile parameters 512 that define drillability factors through various formations are predefined and stored in the model. The well profile parameters 512 include a drillability factor or a relative weight for each formation type. Each formation type is given an identification number and a corresponding drillability factor. The drillability factor is further defined as a function of the borehole depth. The well profile parameters 512 also include a friction factor as a function of the borehole depth, which is further influenced by the borehole inclination and the BHA geometry. Thus, as the drilling progresses through the formation, the model continually accounts for any changes due to the change in the formation and change in the borehole inclination. Since the drilling operation is influenced by the BHA design, the model is provided with a factor for the BHA used for performing the drilling operation. The BHA descriptors 514 are a function of the BHA design which takes into account the BHA configuration (weight and length, etc.). The BHA descriptors 514 are defined in terms of coefficients associated with each BHA type, which are described in more detail later.

The drilling operations are performed by controlling the WOB, rotational speed of the drill string, the drilling fluid flow rate, fluid density and fluid viscosity so as to optimize the drilling rate. These parameters are continually changed based on the drilling conditions to optimize drilling. Typically, the operator attempts to obtain the greatest drilling rate or the rate of penetration or "ROP" with consideration to minimizing drill bit and BHA damage. For any combination of these surface-controlled parameters, and a given type of BHA, the model 500 determines the value of selected downhole drilling parameters and the condition of BHA. The downhole drilling parameters determined include the bending moment, bit bounce, stick-slip of the drill bit, torque shocks, BHA whirl and lateral vibration. The model may be designed to determine any number of other parameters, such as the drag and differential pressure across the drill motor. The model also determines the condition of the BHA, which includes the condition of the MWD devices, mud motor and the drill bit. The output from the box 510 is the relative level or the severity of each computed downhole drilling parameter, the expected ROP and the BHA condition. The severity of the downhole computed parameter is displayed on a display 516, such as a monitor. The severity of the computed parameters determine dysfunctions.

The model preferably utilizes a predefined matrix 519 to determine a corrective action, i.e., the surface controlled parameters that should be changed to alleviate the dysfunctions. The determined corrective action, ROP, and BHA condition are displayed on the display 516. The model continually updates the various inputs and functions as the surface-controlled drilling parameters and the wellbore profile are changed and recomputes the drilling parameters and the other conditions as described above.

Figure 7:
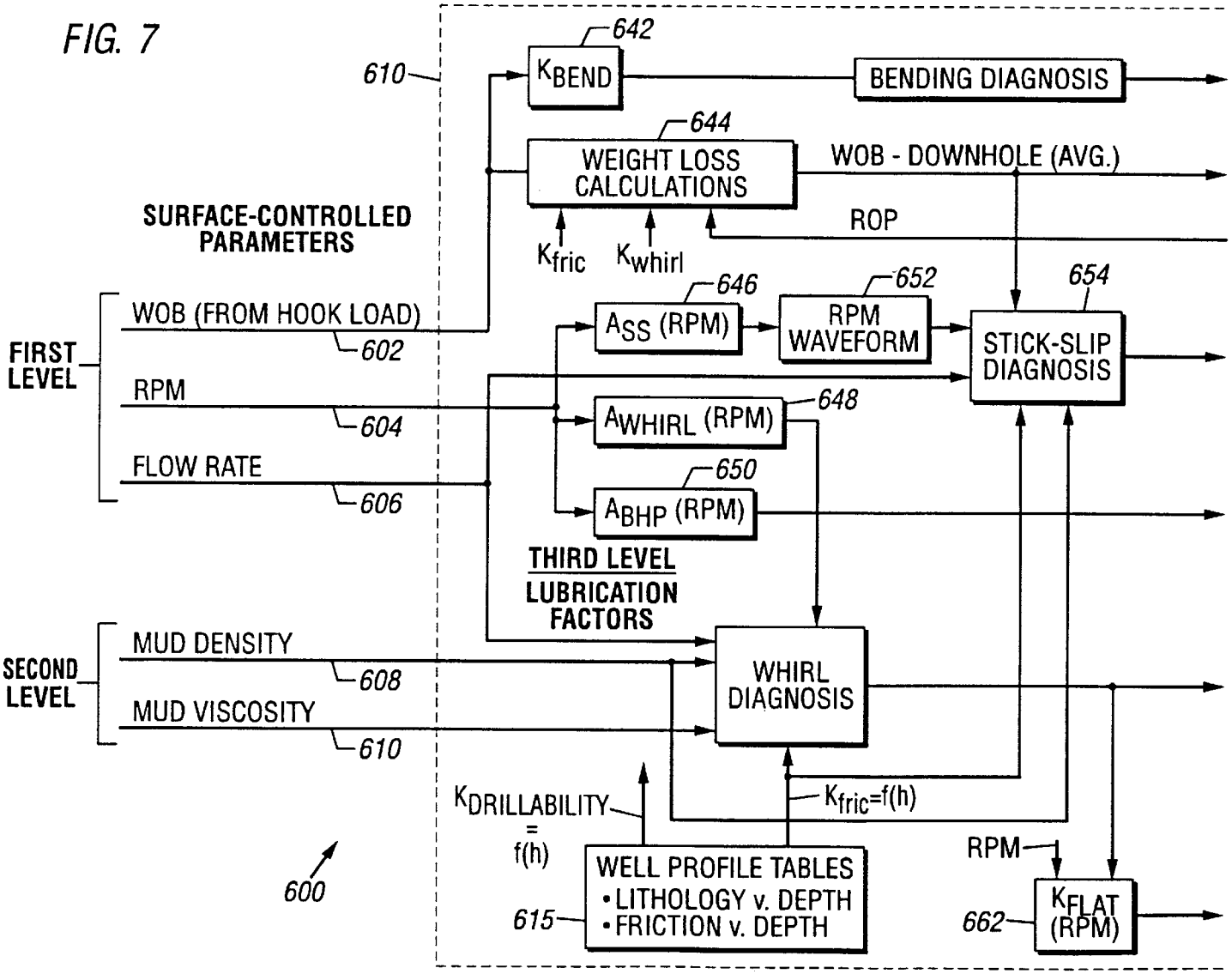
FIG. 7 shows a block diagram showing functional relationship of various parameters used in the model of FIG. 5.
Figure 7:
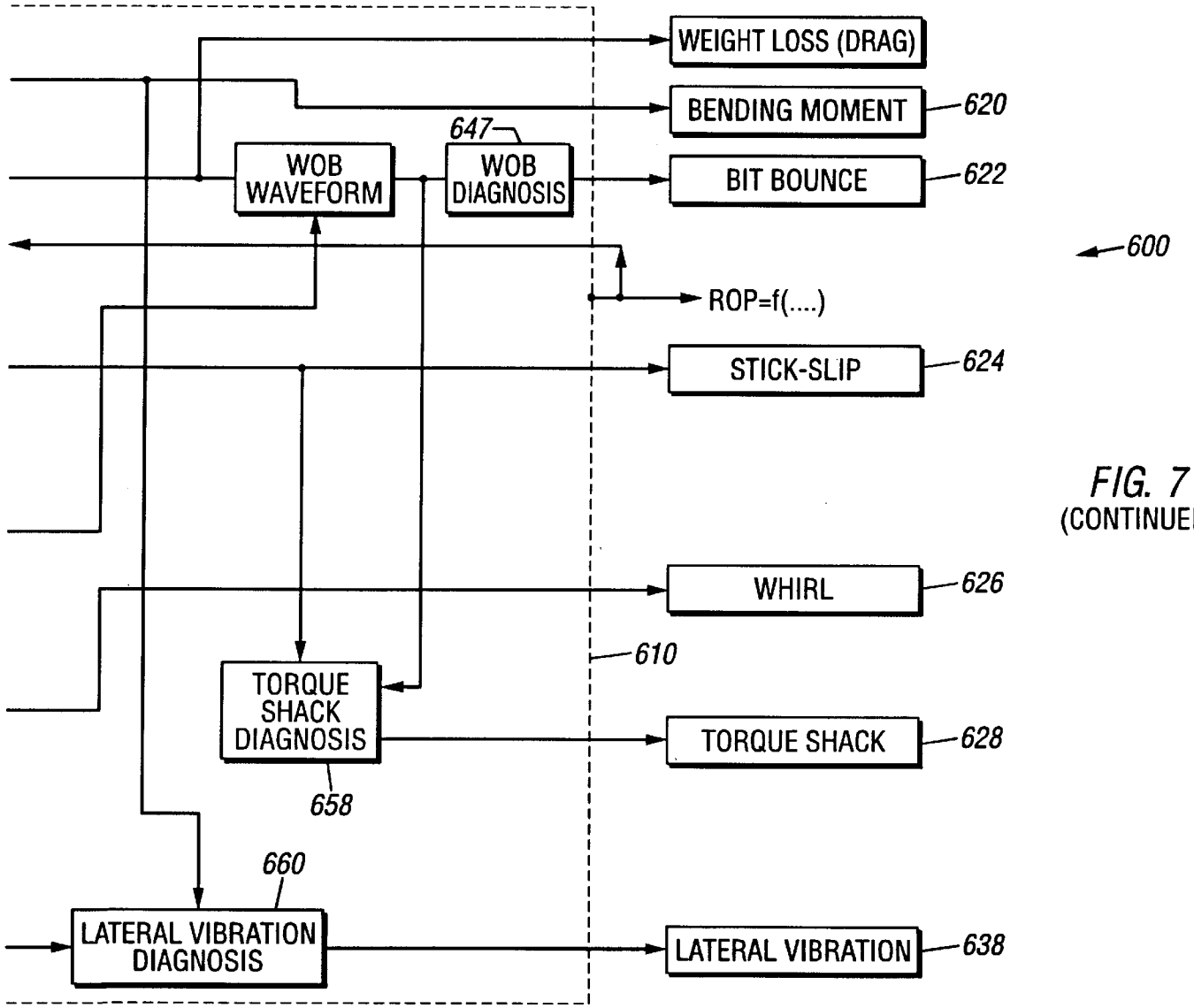

FIG. 7 shows a functional block flow diagram of the interrelationship of various stored and computed parameters utilized by the model of the present invention for simulating the downhole drilling parameters and for determining the corrective actions to alleviate any dysfunctions. The surface control parameters are divided into desired levels or groups, the first or the highest level includes WOB, RPM and the flow rate. Such parameters can readily be changed during the drilling operation. The next level includes parameters such as the mud density and mud viscosity, which require a certain amount of time and preparation before they can be changed and their effect realized. The next level may contain aspects such as changing the BHA configuration, which typically require retrieving the drill string from the borehole and modifying or replacing the BHA and/or drill bit.

Still referring to FIG. 7, the well profile tables 615 contain information about the characteristics of the well that affect the dynamic behavior of the drilling column and its composite parts during the drilling operations. The preferred parameters include lithological factors (which in turn affect the drillability as a function of the borehole depth), a friction factor as a function of the borehole depth and the BHA inclination. The lithology factor is defined as:

$$K_{lith}=f(h)$$

where $K_{lith}$ is the normalized coefficient of lithology and h is the current depth. This parameter defines the rock drillability, i.e., it has a direct affect on the ROP.

The friction factor $K_{fric}$ is the composite part of the friction coefficient between the drill string and the wellbore defined by the mechanical properties of the formation being drilled and may be specified as:

$$K_{fric}=f(h).$$

The inclination as a function of the wellbore depth defines what is referred to as the "dumping factor" for axial, lateral and torsional vibrations, as well as the integrated friction force between the drill string and the wellbore. The inclination effect may be expressed as:

$$A=f(h).$$

The other functions defined for the system relate to the BHA behavior downhole. The purpose of these functions is to define the functional relationship between various parameters describing the BHA behavior. An assumption made is that for a particular bit run simulated by the model, the BHA and drill string configurations are clearly defined, i.e., the critical frequencies for the lateral, axial and torsional vibrations (as a function of the depth) are expressly determined. The quality factor for the resonance curves is assumed to be constant.

The major functions describing the resonance behavior of the BHA/drill string used described below.

Torsional oscillation amplitude (normalized) $A_{ss}$ (referred herein as stick-slip) is defined as function of the surface RPM, i.e.:

$$A_{ss}=f(RPM)$$

where central resonance frequency $F_{o_tor}$ of the function is a function of the current depth h, which may be expressed as:

$$F_o=f(h)$$

Whirl amplitude (normalized) $A_{whirl}$ is defined as follows:

$$A_{whirl}=f(RPM)$$

whose central resonance frequency $F_{o_lat}$ is equal to the critical lateral frequency.

The axial vibration amplitude (normalized) $A_{_bha}$ also is defined as a function of the RPM.

$$A_{_bha}=f(RPM)$$

where the central resonance frequency $F_{_ox}$ is equal to the BHA axial critical frequency.

Typically, the above three functions can be approximated by the Hanning-like normalized curves. The position of each curve on the RPM axis is defined by the central resonance frequency, while the widths are defined by dumping factors for the corresponding resonance phenomena.

The other parametric functions defined are:

Coefficient of lubrication $A_{_lubr}$ as a function of fluid flow rate Q and viscosity $K_{_visc}$:

$$A_{_lubr}=f(Q, K_{_visc})$$

Coefficient of drill string/BHA bending $K_{_bend}$ as a function of surface computed weight on bit $WOB_{_surf}$:

$$K_{_bend}=f(WOB_{_surf})$$

the above two functions are normalized to 1.0.

Referring back to FIG. 7, the system determines the rate of penetration ROP as a function of the various parameters. The bending moment 620 is determined from the WOB and $K_{bend}$ 642. To determine the bit bounce 262, the system determines the true downhole average WOB by performing weight loss calculations 644 based on the $K_{fric}$ and $K_{whirl}$. The true downhole average WOB subtracted from the WOB 602 provides the weight loss or drag. The bit bounce is determined by performing WOB diagnosis based on the WOB wave form affected by $A_{BHA}$ 650. BHA whirl 626 is determined by performing whirl diagnosis as a function of the flow rate, mud density, mud viscosity, $K_{fric}$, and $A_{whirl}$. Lateral vibration 638 is determined from $K_{lat}$ 662, which is a function of the RPM 604 and whirl 656, and the bending diagnosis. To determine the stick slip 624, the system determines the RPM wave form 652 from $A_{ss}$ 646 and RPM 604 and then performs stick-slip diagnosis as a function of true downhole average WOB, RPM wave form 652, $K_{fric}$, mud density 608, mud viscosity 610, and flow rate 606. Torque shock 658 is determined by performing torque diagnosis as a function of the WOB wave form and stick-slip 624.

Each downhole parameter output from the system shown in FIG. 1 has a plurality of levels, preferably eight, which enables the system to determine the severity level of each such parameter and thereby the associated dysfunction based on predefined criteria. As noted earlier, the system also contains instructions, preferably in the form of a matrix 519 (FIG. 6), which is used to determine the nature of the corrective action to be displayed for each set of dysfunctions determined by the system.

Also, the system determines the condition of the BHA assembly used for performing drilling operations. The system preferably determines the condition of the MWD devices, mud motor and drill bit. The MWD condition is determined as a function of the cumulative drilling time on the MWD, $K_{at}$, $K_{whirl}$ and bit bounce. The mud motor condition is determined from the cumulative drilling time, stick-slip, bit bounce $K_{whirl}$, $K_{lat}$ and torque shocks. The drill bit condition is determined from bit bounce, stick slip, torque shocks and the cumulative drilling time. The condition of each of the elements is normalized or scaled from 100–0, where 100 represents the condition of such element when it is new. As the drilling continues, the system continuously determines the condition and displays it for use by the operator.

Figure 8A:
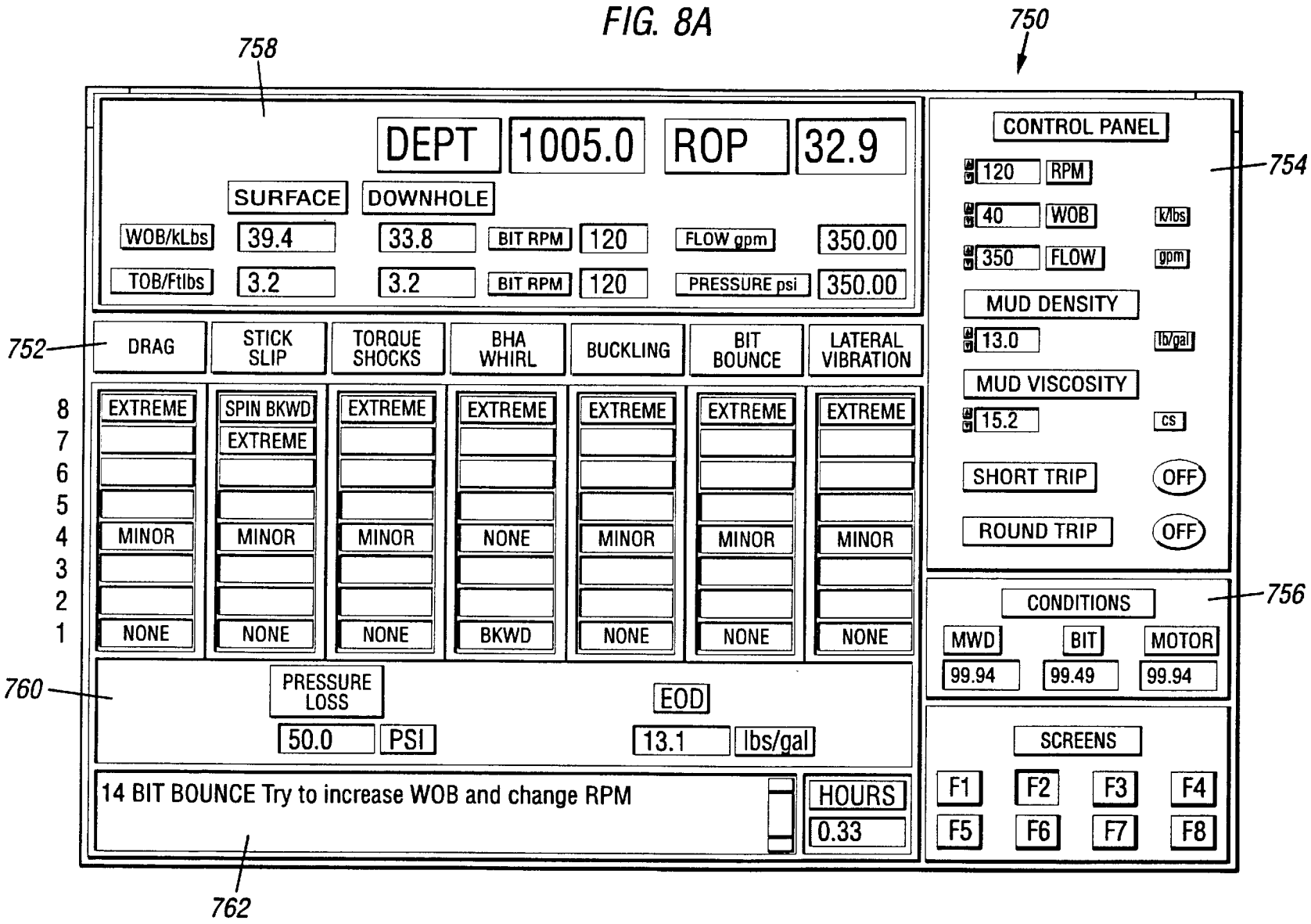
FIG. 8*a* shows an example of a display format showing the severity of dysfunctions relating to certain selected drilling parameters and the display of certain other drilling parameters for use in the system of the present invention.
Figure 8B:
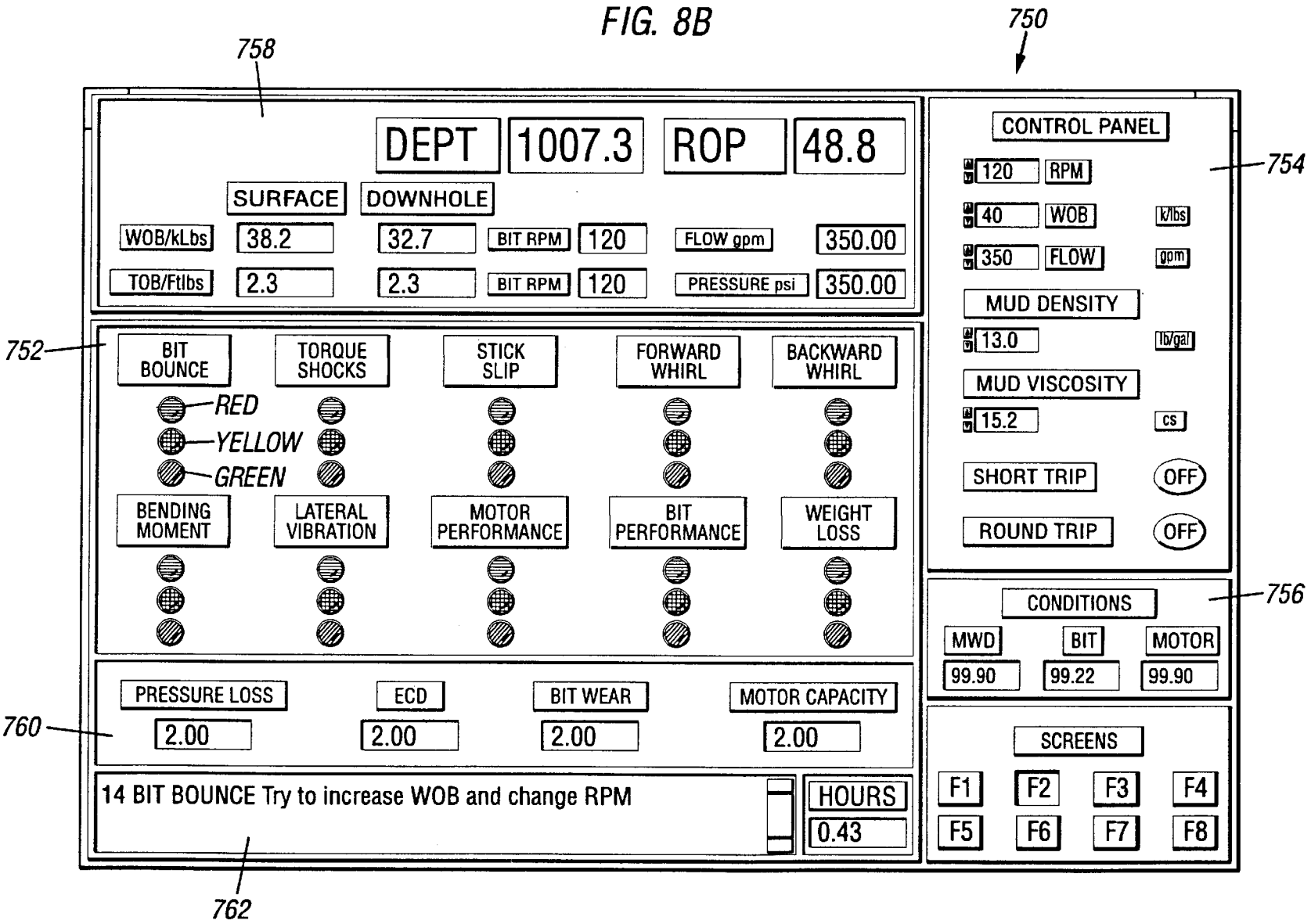
FIG. 8*b* shows another example of the display format for use in the system of the present invention.

Any desired display format may be utilized for the purpose displaying dysfunctions and any other information on the display 42. FIGS. 8*a–b* show examples of the preferred display formats for use with the system of the present invention. The downhole computed parameters of interest for which the severity level is desired to be displayed contain multiple levels. FIG. 8*a* shows such parameters as being the drag, bit bounce, stick slip, torque shocks, BHA whirl, buckling and lateral vibration, each such parameter having eight levels marked 1–8. It should be noted that the present system is neither limited to nor requires using the above-noted parameters nor any specific number of levels. The downhole computed parameters RPM, WOB, FLOW (drilling fluid flow rate) mud density and viscosity are shown displayed under the header "CONTROL PANEL" in block 754. The relative condition of the MWD, mud motor and the drill bit on a scale of 0–100%, 100% being the condition when such element is new, is displayed under the header "CONDITION" in block 756. Certain surface measured parameters, such as the WOB, torque on bit (TOB), drill bit depth and the drilling rate or the rate of penetration are displayed in block 758. Additional parameters of interest, such as the surface drilling fluid pressure, pressure loss due to friction are shown displayed in block 760. Any corrective action determined by the system is displayed in block 762.

FIG. 8*b* shows an alternative display format for use in the present system. The difference between this display and the display shown in FIG. 8*a* is that downhole computed parameter of interest that relates to the dysfunction contains three colors, green to indicate that the parameter is within a desired range, yellow to indicate that the dysfunction is present but is not severe, much like a warning signal, and red to indicate that the dysfunction is severe and should be corrected. As noted earlier, any other suitable display format may be devised for use in the present invention.

In addition to the continuous displays shown in FIGS. 8*a–b,* the system also is programmed to display on command historical information about selected parameters. Preferably a moving histogram is provided for behavior of certain selected parameters as a function of the drilling time, borehole depth and lithology showing the dynamic behavior of the system during normal operations and as the corrective actions are applied.

Figure 8C:
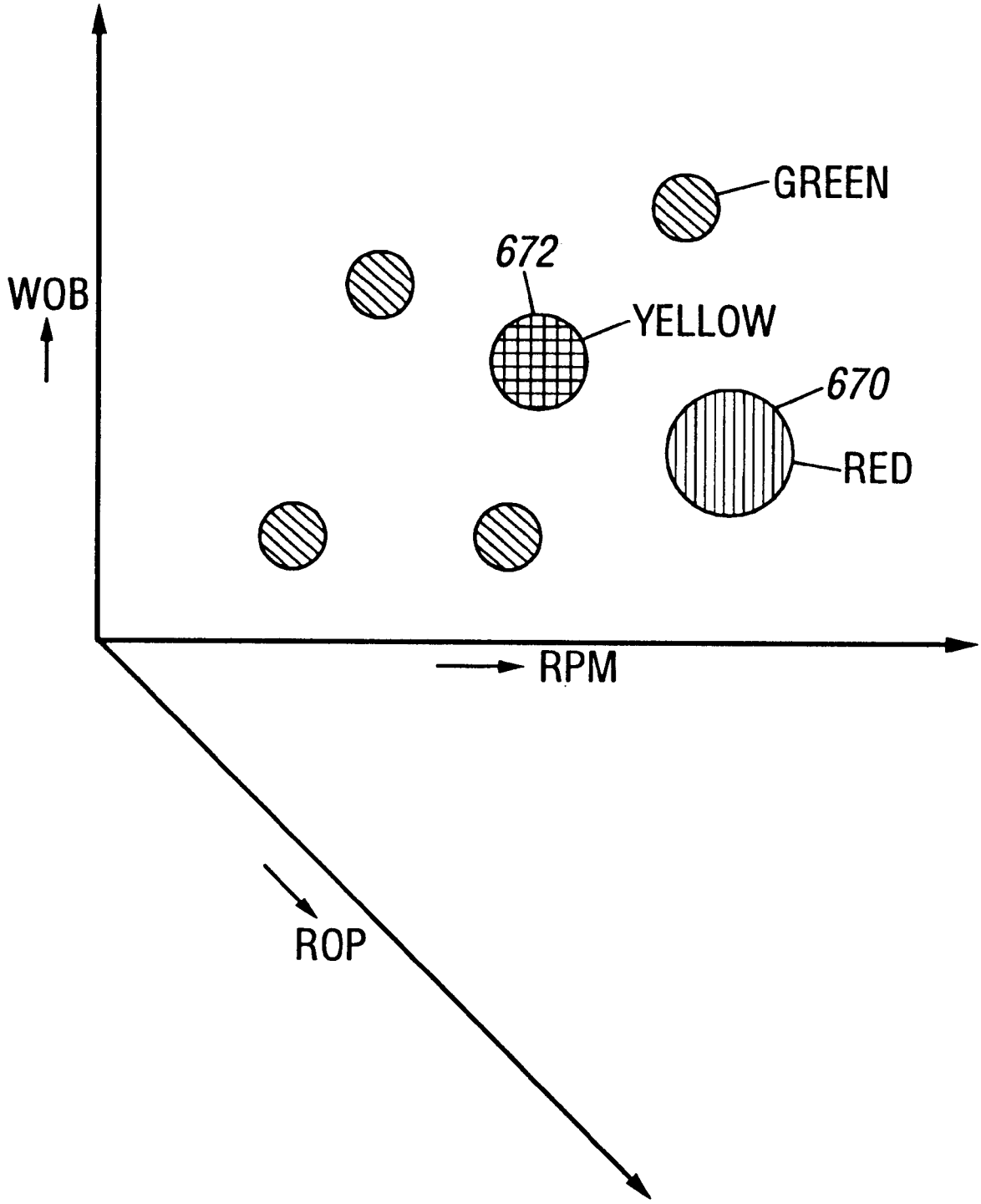
FIG. 8*c* shows a three dimensional graphical representation of the overall behavior of the drilling operation that may be utilized to optimize drilling operations.

Although the general objective of the operator in drilling wellbores is to achieve the highest ROP, such criterion, however, may not produce optimum drilling. For example, it is possible to drill a wellbore more quickly by drilling at an ROP below the maximum ROP but which enables the operator to drill for longer time periods before the drill string must be retrieved for repairs. The system of the present invention displays a three dimensional color view showing the extent of the drilling dysfunctions as a function of WOB, RPM and ROP. FIG. 8*c* shows an example of such a graphical representation. The RPM, WOB and ROP are respectively shown along the x-axis, y-axis and z-axis. The graph shows that higher ROP can be achieved by drilling the wellbore corresponding to the area 670 compared to drilling corresponding to the area 672. However, the area 670 shows that such drilling is accompanied by severe (for example red) dysfunctions compared to the area 672, wherein the dysfunctions are within acceptable ranges (yellow). The system thus provides continuous feedback to the operator to optimize the drilling operations.

Figure 8D:
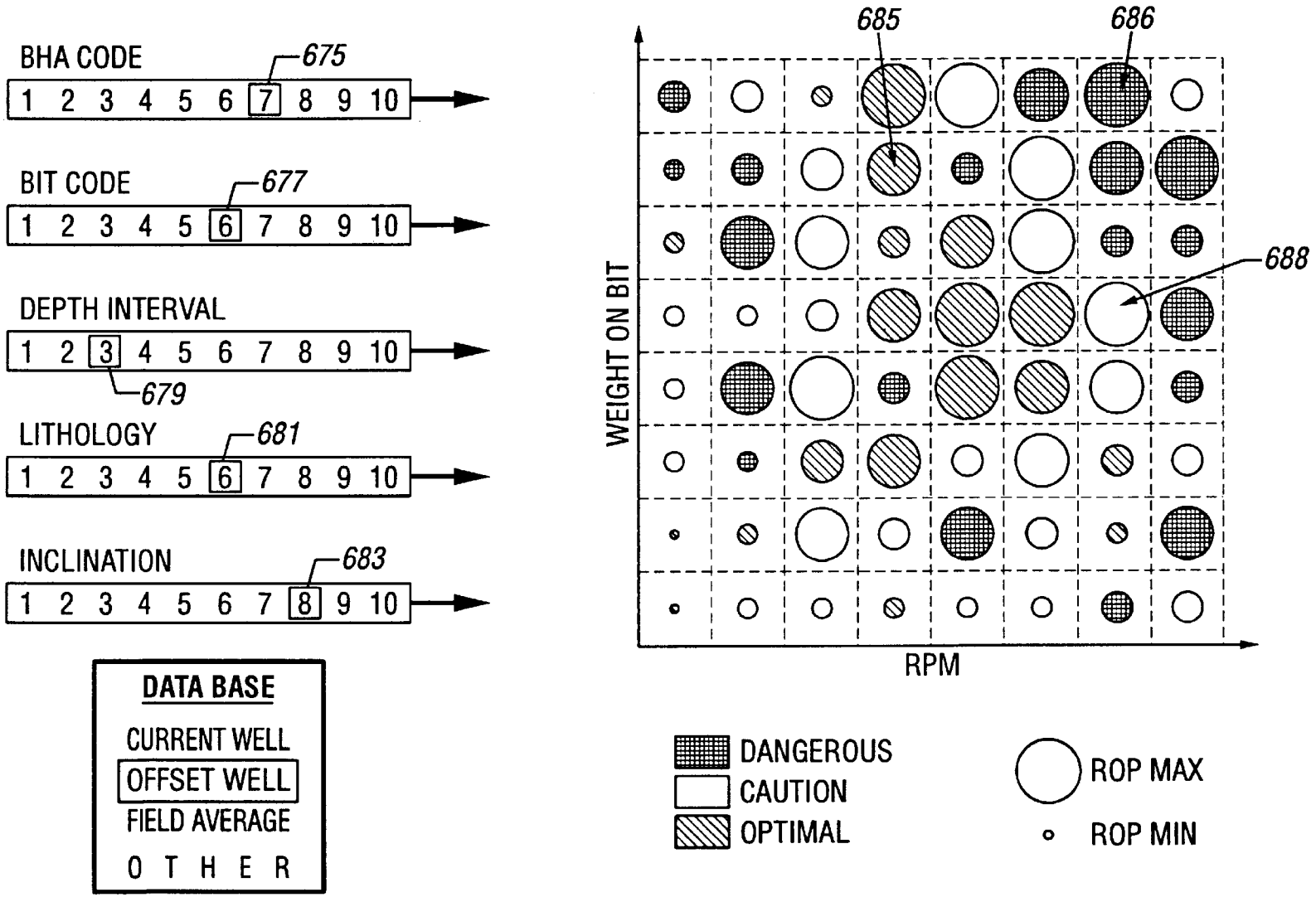
FIG. 8*d* shows in a graphical representation the effect on drilling efficiency as a function of selected drilling parameters, namely weight-on-bit and drill bit rotational speed), for a given set of drill string and borehole parameters.

FIG. 8*d* is an alternative graphical representation of drilling parameters, namely WOB and drill bit rotational speed on the ROP for a given set of drill bit and wellbore parameters. The values of each such parameter are normalized in a predetermined scale, such as a scale of one to ten shown in FIG. 8*d.* The driller inputs the value for each such parameter that most closely represents the actual condition. In the example of FIG. 8*d,* the parameters selected and their corresponding values are: (a) the type of BHA utilized for drilling has a relative value seven 675; (b) the type of drill bit employed has a relative value six 677 on the drill bit scale ; (c) the depth interval has a relative value three 679; (d) the lithology or the formation through which drilling is taking place is six 681; and (e) the BHA inclination relative value is eight 683. It should be noted that other parameters may also be utilized. The simulator of the present invention utilizes a predefined data base and models. The data base may include information from the current well being drilled, offset wells, wells in the field being developed and any other relevant information. A synthetic example of the effect of the selected parameters on the ROP as a function of the WOB and RPM is shown in FIG. 8*d,* which is presented on a screen. The WOB is shown along the vertical axis and the RPM along the horizontal axis. Green circles 685, indicate safe operating conditions, yellow circles 686 indicate unacceptable operating conditions, and uncolored circles 688 indicate marginal or cautionary conditions. The size of the circle indicates the operating range corresponding to that condition. The system may be programmed to provide a three dimensional view. The example of FIG. 8*d* utilizes two variable, namely WOB and RPM. The system may be an n-dimensional system, wherein n is greater than two and represents the number of variables.

For performing simulation, the system of the present invention contains one or more models that are designed to determine a number of different dysfunctions scenarios as a function of the surface controlled parameters, well bore profile parameters and BHA parameters defined for the system. The system continually updates the model based on the changing drilling conditions, computes the corresponding dysfunctions, displays the severity of the dysfunctions and values of other selected drilling parameters and determines the corrective actions that should be taken to alleviate the dysfunctions. The presentation may be scaled in time such that the time can be made to appear real or accelerated to give the user a feeling of the actual response time for correcting the dysfunctions. All corrections for the simulator can be made through a control panel that contains the surface controlled parameters. An adjustment made in the proper direction to the surface controlled parameters as recommended by the corrective action or "advice" should cause the system to return to normal operation and remove the dysfunctions in a controlled manner to appear as in the real drilling environment. The display shows the effect, if any, of a change made in the surface controlled parameter on each of the displayed parameters. For example, if the change in WOB results in a change in the bit bounce from an abnormal (red) condition to a more acceptable condition (yellow), then the system automatically will reflect such a change on the display, thereby providing the user with an instant feed back or selectively delayed response of the effect of the change in the surface controlled parameter.

Thus, in one aspect, the present invention senses drilling parameters downhole and determines therefrom dysfunctions, if any. It quantifies the severity of each dysfunction, ranks or prioritizes the dysfunctions, and transmits the dysfunctions to the surface. The severity level of each dysfunction is displayed for the driller and/or at a remote location, such as a cabin at the drill site. The system provides substantially online suggested course of action, i.e., the values of the drilling parameters (such as WOB, RPM and fluid flow rate) that will eliminate the dysfunctions and improve the drilling efficiency. The operator at the drill rig or the remote location may simulate the operating condition, i.e., look ahead in time, and determine the optimum course of action with respect to values of the drilling parameters to be utilized for continued drilling of the wellbore. The models and data base utilized may be continually updated during drilling.

In many cases, especially offshore, multiple wellbores are drilled from a single platform or location, each such wellbore having a predefined well profile (borehole size and wellpath). The information gathered during the first wellbore, such as the type of drill bit that provided the best drilling results for a given type of rock formation, the bottomhole assembly configuration, including the type of mud motor used, the severity of dysfunctions at different operating conditions through specific formations, the geophysical information obtained relating to specific subsurface formations, etc., is utilized to develop drilling strategy for drilling subsequent wellbores. This may entail altering the drilling assembly configuration, utilizing different drill bits for different formations, utilizing different ranges for weight on bit, rotational speed and drilling fluid flow rates, and utilizing different viscosity fluid compared to utilized for drilling prior wellbores. This learning process and updating process is continued for drilling any subsequent wellbores. The above-noted information also is utilized to update any models utilized for drilling subsequent wellbores.

Thus far the description has related to the specific preferred embodiments of the drilling system according to the present invention and some of the preferred modes of operation. However, the overall drilling objective is to provide an automated closed-loop drilling system and method for drilling oilfield wellbores with improved efficiency, i.e. at enhanced drilling speeds (rate of penetration) and with enhanced drilling assembly life. In some cases, however, the wellbore can be drilled in a shorter time period by choosing slower ROP's because drilling at such ROP's can prevent bottomhole assembly failures and reduce drill bit wear, thereby allowing greater drilling time between repairs and drill bit replacements. The overall operation of the drilling system of the present invention will now be described while referring to the general tool configuration of FIG. 9 and the block functional diagram of FIG. 10.

Figure 9:
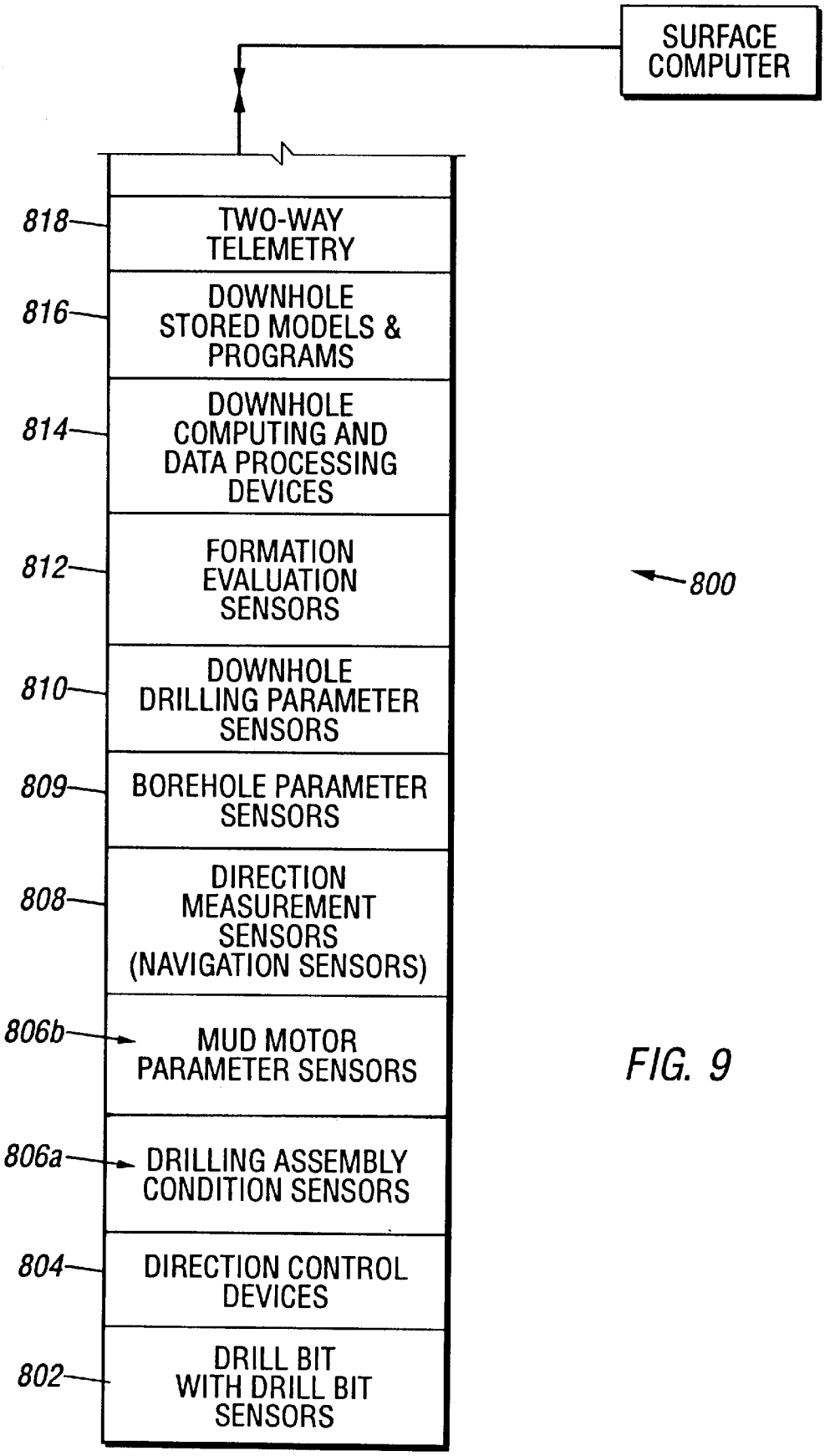
FIG. 9 shows a generic drilling assembly for use in the system of the present invention.

Referring generally to FIGS. 1–9 and particularly to FIG. 9, the drilling system of the present invention contains sources for controlling drilling parameters, such as the fluid flow rate, rotational speed of the drill bit and weight on bit, surface control unit with computers for manipulating signals and data from surface and downhole devices and for controlling the surface controlled drilling parameters and a downhole drilling tool or assembly 800 having a bottom hole assembly (BHA) and a drill bit 802. The drill bit has associated sensors 806*a* for determining drill bit wear, drill bit effectiveness and the expected remaining life of the drill bit 802. The bottomhole assembly 800 includes sensors for determining certain operating conditions of the drilling assembly 800. The tool 800 further includes: (a) desired direction control devices 804, (b) device for controlling the weight on bit or the thrust force on the bit, (c) sensors for determining the position, direction, inclination and orientation of the bottomhole assembly 800 (directional parameters), (d) sensors for determining the borehole condition (borehole parameters), (e) sensors for determining the operating and physical condition of the tool during drilling (drilling assembly or tool parameters), (f) sensors for determining parameters that can be controlled to improve the drilling efficiency (drilling parameters), (g) downhole circuits and computing devices to process signals and data downhole for determining the various parameters associated with the drilling system 100 and causing downhole devices to take certain desired actions, (h) a surface control unit including a computer for receiving data from the drilling assembly 800 and for taking actions to perform automated drilling and communicating data and signals to the drilling assembly, and (h) communications devices for providing two-way communication of data and signals between the drilling assembly and the surface. One or more models and programmed instructions (programs) are provided to the drilling system 100. The bottom hole assembly and the surface control equipment utilize information from the various sensors and the models to determine the drilling parameters that if used during further drilling will provide enhanced rates of penetration and extended tool life. The drilling system can be programmed to provide those values of the drilling parameters that are expected to optimize the drilling activity and continually adjust the drilling parameters within predetermined ranges to achieve such optimum drilling, without human intervention. The drilling system 100 can also be programmed to require any degree of human intervention to effect changes in the drilling parameters.

The drilling assembly parameters include bit bounce, stick-slip of the BHA, backward rotation, torque, shock, BHA whirl, BHA buckling, borehole and annulus pressure anomalies, excessive acceleration, stress, BHA and drill bit side forces, axial and radial forces, radial displacement, mud motor power output, mud motor efficiency, pressure differential across the mud motor, temperature of the mud motor stator and rotor, drill bit temperature, and pressure differential between drilling assembly inside and the wellbore annulus. The directional parameters include the drill bit position, azimuth, inclination, drill bit orientation, and true x, y, and z axis position of the drill bit. The direction is controlled by controlling the direction control devices 804, which may include independently controlled stabilizers, downhole-actuated knuckle joint, bent housing, and a bit orientation device.

The downhole tool 800 includes sensors 809 for providing signals corresponding to borehole parameters, such as the borehole temperature and pressure. Drilling parameters, such as the weight on bit, rotational speed and the fluid flow rate are determined from the drilling parameter sensors 810. The tool 800 includes a central downhole central computing processor 814, models and programs 816, preferably stored in a memory associated with the tool 800. A two-way telemetry 818 is utilized to provide signals and data communication between the tool 800 and the surface.

Figure 10:
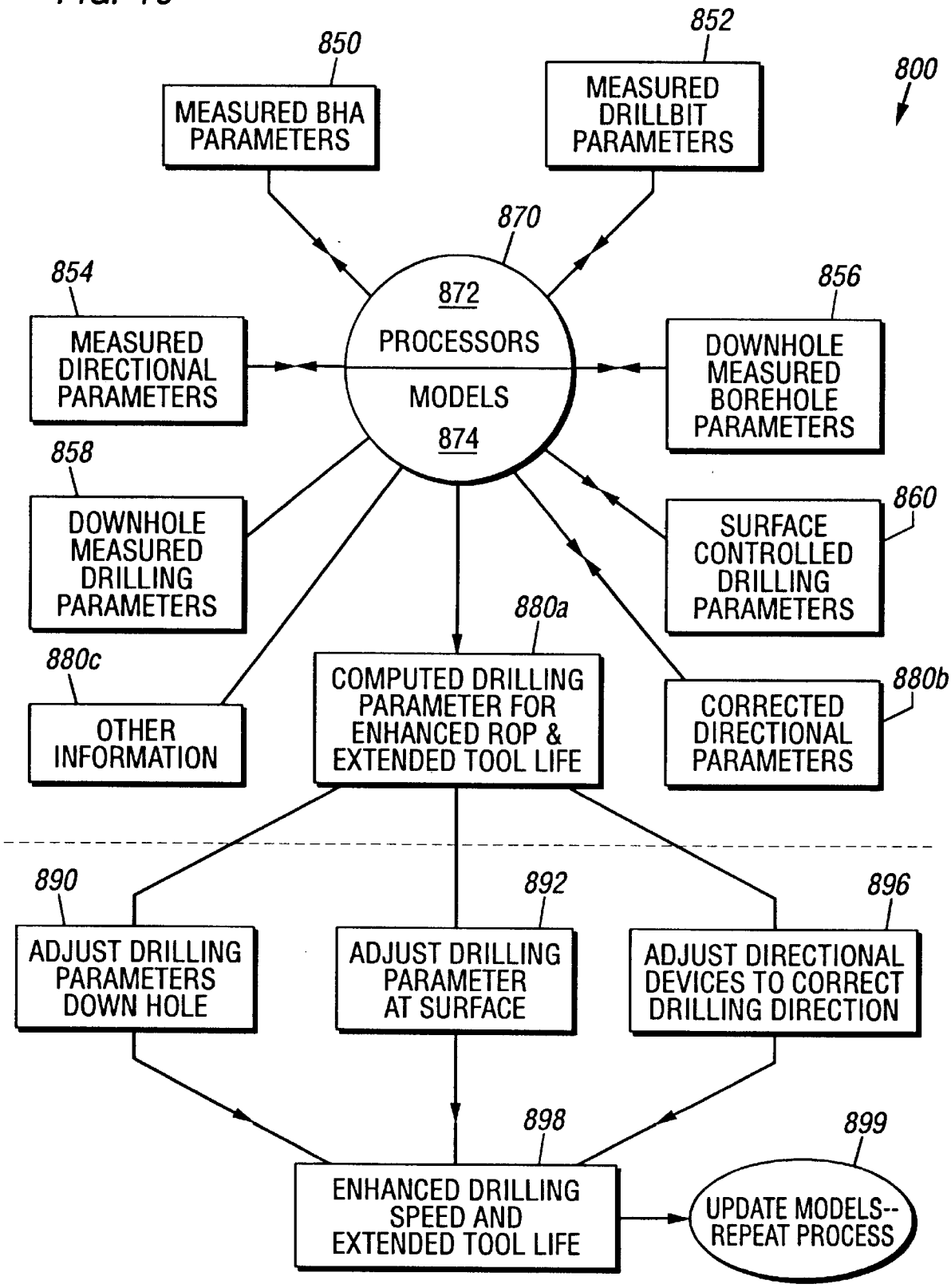
FIG. 10 a functional block diagram of the overall relationships of various types of drilling, formation, borehole and drilling assembly parameters utilized in the drilling system of the present invention to effect automated closed-loop drilling operations of the present invention.

FIG. 10 shows the overall functional relationship of the various aspects of the drilling systems 100 described above. To effect drilling of a borehole, the tool 800 (FIG. 9) is conveyed into borehole. The system or the operator sets the initial drilling parameters to start the drilling. The operating range for each such parameter is predefined. As the drilling starts, the system determines the BHA parameters 850, drill bit parameters 852, borehole parameters 856, directional parameters 854, drilling parameters 858, surface controlled parameters 860, directional parameters 880*b,* and any other desired parameters 880*c.* The processors 872 (downhole computer or combination of downhole and surface computers) utilizes the parameters and measurement values and processes such values utilizing the models 874 to determine the drilling parameters 880*a,* which if used for further drilling will result in enhanced drilling rate and or extended tool life. As noted earlier, the operator and or the system 100 may utilize the simulation aspect of the present invention and look ahead in the drilling processor and then determine the optimum course of action. The result of this data manipulation is to provide a set of the drilling parameter and directional parameters 880*a* that will improve the overall drilling efficiency. The drilling system 800 can be programmed to cause the control devices associated with the drilling parameters, such as the motors for rotational speed, drawworks or thrusters for WOB, fluid flow controllers for fluid flow rate, and directional devices in the drill string for drilling direction, to automatically change any number of such parameters. For example, the surface computer can be programmed to change the drilling parameters 892, including fluid flow rate, weight on bit and rotational speed for rotary applications. For coiled-tubing applications, the fluid flow rate can be adjusted downhole and/or at the surface depending upon the type of fluid control devices used downhole. The thrust force and the rotational speed can be changed downhole. The downhole adjusted parameters are shown in box 890. The system can alter the drilling direction 896 by manipulating downhole the direction control devices. The changes described can continually be made automatically as the drilling condition change to improve the drilling efficiency. The above-described process is continually or periodically repeated, thereby providing an automated closed loop drilling system for drilling oilfield wellbores with enhanced drilling rates and with extended drilling assembly life 898. The system 800 may also be programmed to dynamically adjust any model or data base as a function of the drilling operations being performed as shown by box 899. As noted earlier, the system models and data 874 are also modified based on the offset well, other wells in the same field and the current well being drilled, thereby incorporating the knowledge gained from such sources into the models for drilling future wellbores.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A system for drilling from surface wellbores in subsurface formations from a surface , comprising:

(a) a drill string having (i) a drilling assembly carrying a drill bit at a bottom end of the drilling assembly for drilling a wellbore, (ii) a plurality of sensors carried by the drill string making measurements of a plurality of drill string parameters during drilling of the wellbore, (iii) a processor carried by the drilling assembly computing from said measurements values of the drill string parameters, and (iv) a transmitter associated with the drill string transmitting signals representative of the values of the drill string parameters to the surface; and (b) a computer at the surface receiving the transmitted signals, said computer categorizing said received signals into a plurality of severity levels for each said drill string parameter, at least one such level indicative of a dysfunction for each said selected drill string parameter, said computer further displaying said categorized levels on a display.

2. The system according to claim 1, further comprising a model associated with the surface computer and wherein the surface computer utilizing said model determines at least one drilling parameters that will alleviate said dysfunctions when utilized for further drilling of the wellbore.

3. The system according to claim 2, wherein the model includes a predefined matrix correlating drilling parameters with the dysfunctions.

4. The system according to claim 1, wherein the drill string parameters are selected from a group consisting of bending moment, radial motion, axial motion, rotational motion, acceleration.

5. The system according to claim 1, wherein the drill string parameters are selected from a group consisting of bit bounce, torque, shock, vibration, pressure, rotation, pressure anomaly, acceleration, bit side force, mud motor condition, differential pressure, bearing condition, stick-slip, whirl, and bending moment.

6. The system according to claim 1, wherein the transmitter communicates via a medium selected from a group consisting of electromagnetic, tubing acoustic, fluid acoustic, mud pulse, fiber optics, and electric conductor.

7. The system according to claim 1, wherein the downhole sensors are selected from the group comprising, accelerometer, magnetometer, gyroscopes, strain gage, force on bit sensors, and drill bit wear sensor.

8. The system according to claim 2, wherein the drilling parameters are selected from the group consisting of weight-on-bit, fluid flow rate, drill bit rotational speed, drilling fluid viscosity, and drilling fluid density.

9. The system according to claim 2, wherein the surface computer periodically updates the model based on the received signals.

10. The system according to claim 1, further comprising a data base for use by the surface computer, said data base containing information selected from a group consisting of information about preexisting wellbores, offset wellbores, seismic surveys, and geological structures of subsurface formations.

11. A simulator for simulating drilling of a borehole having a given borehole profile and drilled by a given bottom hole assembly (BHA), said system comprising:

(a) a computer;

(b) a memory associated with said computer for storing therein programmed instructions; and (c) a model associated with said computer, said model having defined therein parameters relating to the BHA and the borehole profile and a functional relationship that correlates selected BHA parameters with selected drilling parameters for the given BHA and the borehole profile, and wherein said computer upon the input of a set of drilling parameters thereto utilizes said program and provides expected values of the selected BHA parameters and their severity levels.

12. The simulator according to claim 11, wherein one said severity level represents a dysfunction for each of the selected BHA parameters and wherein the computer further determines which f the selected drilling parameters are required to be changed to alleviate the dysfunctions.

13. The simulator according to claim 11, wherein the simulator includes a visual display and the computer displays the severity level of the selected BHA parameters, the drilling parameters and drilling parameters required to be changed.

14. The system according to claim 11, wherein the BHA parameters are selected from the group consisting of bit bounce, torque, shock, vibration, rotation, stick-slip, whirl, bending moment, backward rotation, pressure anomaly, acceleration, drill bit side force, mud motor condition, pressure differential across mud motor, condition of a bearing assembly in the BHA, and drill bit condition.

15. The system according to claim 11, wherein the drilling parameters are selected from group consisting of weight-on-bit, fluid flow rate, drilling fluid viscosity, drilling fluid density, and drill bit rotational speed.

16. A method of drilling an oilfield wellbore with a drilling system having a drilling assembly and a drill bit at an end thereof at enhanced drilling rates and with extended drilling assembly life, said drilling assembly conveyable with a tubing into the wellbore, said drilling assembly containing a plurality of downhole sensors for determining parameters relating to the formations surrounding the wellbore and the condition of the drilling assembly elements, comprising:

(a) conveying the drilling assembly with the tubing into the wellbore for drilling the wellbore;

(b) initiating drilling of the wellbore with the drilling assembly utilizing a plurality of known initial drilling parameters;

(c) determining from the downhole sensors, during drilling of the wellbore, dysfunctions relating to selected drilling assembly parameters;

(d) providing a computer at the surface and a model that correlates the drilling assembly parameters to the drilling parameters and wherein the computer utilizing said model determines specific drilling parameters that when changed for further drilling of the wellbore will alleviate dysfunctions relating to the drilling assembly; and (e) further drilling the wellbore by changing at least one of the specific drilling parameters to improve the overall drilling efficiency.

17. A method of drilling a wellbore utilizing a drill string having a drill bit at an end thereof, comprising:

(a) making measurements relating to a plurality of drill string parameters during drilling of the wellbore;

(b) determining downhole severity of the drill string parameters from the measurements;

(c) transmitting data to the surface corresponding to the severity of the drill string parameters;

(d) determining at the surface by a computer and by utilizing a model at least one drilling parameter which when changed will alleviate the dysfunctions relating to a drill string parameter during continued drilling of the wellbore; and (e) continuing drilling of the wellbore by changing the at least one drilling parameter.

18. A system for drilling wellbores in subsurface formations from the surface, comprising:

(a) a drill string having (i) a drilling assembly carrying a drill bit at a bottom end of the drilling assembly for drilling a wellbore, (ii) a plurality of sensors carried by the drilling assembly making measurements of a plurality of drilling assembly parameters during drilling of the wellbore, (iii) a processor carried by the drilling assembly computing from said measurements values of drilling assembly parameters, and (iv) a transmitter associated with the drill string transmitting signals representative of the drilling assembly parameters to the surface; and (b) a surface computer receiving the transmitted signals, said computer determining from said received signals and a model provided thereto values of at least one drilling parameter that when utilized for continued drilling of the wellbore would improve the drilling efficiency.

19. The system according to claim 18, wherein the drilling assembly parameters are selected from a group consisting of bit bounce, torque, shock, vibration, rotation, stick-slip, whirl, bending moment, backward rotation, pressure anomaly, acceleration, drill bit side force, mud motor condition, pressure differential across mud motor, condition of a bearing assembly in the BHA, and drill bit condition.

20. The system according to claim 18, wherein the drilling parameters are selected from group consisting of weight-on-bit, fluid flow rate, drilling fluid viscosity, drilling fluid density, and drill bit rotational speed.

21. The system according to claim 20, wherein the computer utilizes at least one well profile parameter and at least one drilling assembly descriptor provided to said computer to determine the at least one drilling parameter.

22. The system according to claim 21, wherein the at least one well profile parameter is selected from a group consisting of a lithological parameter, friction and inclination of the drilling assembly.

23. The system according to claim 22, wherein the at least one drilling assembly descriptor is selected from a group consisting of a drilling assembly configuration, weight of the drilling assembly and length of the drilling assembly.

24. The system according to claim 13, wherein the drilling efficiency is a function of rate of penetration of the drilling assembly into the subsurface formations and the operating life of at least one component of the drilling assembly.

25. The system according to claim 18, wherein the drilling assembly further includes sensors measuring at least one drilling parameter during the drilling of the wellbore and transmitting signals representative of such measurements to the surface computer.

26. The system according to claim 25, wherein said surface computer determines the relative severity level of each said drilling assembly parameter and displays said severity level and value of at least one downhole measured drilling parameter on a display of the system.

* * * * *